US005350179A

United States Patent [19]

Hill et al.

[11] Patent Number: 5,350,179

[45] Date of Patent: Sep. 27, 1994

[54] DRUG AWARENESS GAME AND METHOD FOR PLAYING

[76] Inventors: Ronald D. Hill; Adam G. Marglon, both of 5715 Engle Rd., Apt. K, Carmichael, Calif. 95608; David P. Johnson, 647 Ellis Rd., Marysville, Calif. 95901

[21] Appl. No.: 105,332

[22] Filed: Aug. 10, 1993

[51] Int. Cl.[5] ..... A63F 3/00

[52] U.S. Cl. ..... 273/249

[58] Field of Search ..... 273/236, 242, 243, 248, 273/249

[56] References Cited

U.S. PATENT DOCUMENTS

| | | | |
|---|---|---|---|
| 3,759,521 | 9/1973 | Breslow | 273/243 |
| 3,977,680 | 8/1976 | Lavine . | |
| 4,012,045 | 3/1977 | Vail . | |
| 4,053,154 | 10/1977 | Niemann . | |
| 4,201,388 | 5/1980 | Cantelon . | |
| 4,216,966 | 8/1980 | MacRae . | |
| 4,962,934 | 10/1990 | Taylor . | |
| 5,071,134 | 12/1991 | Burroughs, Jr. . | |
| 5,080,369 | 1/1992 | Mongno | 273/243 |
| 5,139,268 | 8/1992 | Garnett . | |
| 5,190,292 | 3/1993 | Perry | 273/243 X |
| 5,215,309 | 6/1993 | Joel | 273/243 |
| 5,224,862 | 7/1993 | Sullivan | 273/243 X |

FOREIGN PATENT DOCUMENTS

| | | | |
|---|---|---|---|
| 2231277 | 11/1990 | United Kingdom | 273/243 |
| 2250925 | 6/1992 | United Kingdom | 273/243 |

*Primary Examiner*—William E. Stoll

*Attorney, Agent, or Firm*—James M. Ritchey

[57] ABSTRACT

A board game apparatus (10) wherein players assume the identities of police officers and fight the war against crack cocaine. Board game apparatus (10) is divided into a first main region (24), a second main region (26), a third main region (28) and a fourth main region (30) wherein a pathway (52), communicates between the four main regions. Pathway (52) in first main region (24) has a plurality of playing positions wherein a player must obtain a plurality of prerequisite items for fighting the war on crack cocaine, such as a bulletproof vest, a task force, armaments, a police badge and a search warrant. Pathway (52) in second main region (26), third main region (28) and fourth main region (30) contain playing positions which give instructions, give information, give both information and instructions, designate barricade positions, designate neutral positions, require the drawing of cards, or the like. Additionally board game apparatus (10) includes a set of guidance cards (14) for guiding the movements of players and a set of guilt determination cards (16) for determining the guilt or innocence of a plurality of criminals existing in the game. A police chart (18) allows players to monitor their progress while playing the board game apparatus (10).

29 Claims, 9 Drawing Sheets

| | | | |
|---|---|---|---|
| GO DIRECTLY TO THE POLICE STATION... THE CHIEF IS MAD! SKIP 2 TURNS | THE CHIEF WANTS TO GIVE YOU YOUR PAYCHECK. GO TO THE POLICE STATION, SKIP A TURN AND ADD 50 POINTS | GO DIRECTLY TO MR. BIG CHEESE'S HOSTAGE HOLDING CELL | GO TO THE HOSPITAL AND VISIT YOUR DOCTOR. YOU SMOKE TOO MUCH... LOSE 30 POINTS |
| GO TO ANY SQUARE YOU WANT THEN SKIP 2 TURNS | YOU SHOT TWO CRACKHEADS IN A SHOOT-OUT (DRAW GUILTY OR INNOCENT CARD) | GO BUST ANY CRACKHEAD YOU WANT ON ANY SQUARE! | YOU JUST FOUND EXPLOSIVES BUT WHILE AN OFFICER WAS CARRYING IT, HE TRIPPED AND... BOOM, YOU LOST YOUR TASK FORCE! |
| YOU'VE BEEN IN A SHOOTOUT WITH THE CRACKHEADS!!! YOU GOT SHOT IN THE ARM... GO TO THE HOSPITAL AND SKIP 1 TURN. | YOU CAUGHT ONE CRACKHEAD SMOKING CRACK, BUST HIM AND CONFISCATE 1 BAG OF CRACK. | YOU'RE CRUSIN' UP 13th STREET AND YOU SEE 2 CRACKHEADS CHASING AN OLD LADY... BUST 2 CRACKHEADS AND ADD 10 POINTS. | JAILBREAK!!! ALL PLAYERS REPORT TO PRISON AREA. EACH PLAYER LOSES 2 CRACKHEADS. |
| ANTI-DEATH CARD. THE HOLDER OF THIS CARD CAN NEVER DIE!!! YOU DON'T NEED A TASK FORCE, KEEP THIS CARD! (GOOD FOR ONE TURN) | YOU GOT SHOT BY A PSYCHO CRACKHEAD (LOSE YOUR B.P. VEST). | PRISON RIOT!!! ALL PLAYERS REPORT TO PRISON AREA... EACH PLAYER CAN ADD 20 POINTS | YOU'VE JUST CONFISCATED 20 BAGS OF CRACK. |

14

FIG. – 3A

YOU'VE JUST LOST YOUR GUN.. 2 OFFICERS WERE SHOT DEAD!

YOU JUST CONFISCATED 60 POINTS OF DRUG MONEY.

A LATE NIGHT STAKEOUT... GO TO THE SHIPPING YARD SKIP 1 TURN THEN BUST 5 CRACKHEADS!

IT'S YOUR LUCKY DAY!!! YOU'VE FOUND A POUND OF CRACK IN MR. BIG CHEESE'S CAR... PICK UP A GUILTY CARD AND YOU WIN OR INNOCENT AND BACK ON THE STREETS.

YOU'VE WALKED DOWN A DARK ALLEY AND GOT BEAT UP... GO TO THE HOSPITAL AND SKIP 1 TURN!

YOU'VE LOST YOUR SEARCH WARRANT, GO TO THE POLICE STATION AND GET ANOTHER!

YOU'VE JUST LOST 3 OFFICERS! GO TO THE CEMETERY... SKIP 1 TURN.

YOUR AUNT AGNESS'S YOUNGER SISTER'S HUSBAND'S FRIEND'S YOUNGER BROTHER'S BABY-SITTER DIED.. GO TO THE GRAVEYARD AND SKIP 1 TURN!

IF YOU HAVE A TASK FORCE AND A SEARCH WARRANT BUST THE CRACK LAB... ADD 3 CRACKHEADS.

YOU'VE CAUGHT 2 CRACKHEADS IN THE SCHOOL TRYING TO SELL CRACK TO A COUPLE OF KIDS. THERE'S NO NEED TO DRAW A GUILTY OR INNOCENT CARD.. THESE SUSPECTS ARE ALREADY GUILTY.

THERE IS A CRACKHEAD IN THE PARKING LOT STEALING STEREOS ADD 1 CRACKHEAD AND STOLEN ITEMS.

14

FIG. – 3B

DRUG AWARENESS GAME AND METHOD FOR PLAYING

BACKGROUND OF THE INVENTION

1. Field of the Invention

This invention pertains to the field of board games generally, and more particularly pertains to a board game apparatus for making player's aware of the criminal consequences of engaging in the use and trafficking of crack cocaine.

2. Description of the Background Art

In society, today, drug use persists and remains as a blight on society which contributes to an increased crime rate and ruined lives. A particularly persistent drug known for its uncanny addictiveness is crack cocaine, which has become the focus of law enforcement, in many locations. The sale and trafficking of crack cocaine has resulted in a substantial underground economy wherein heavy-handed criminals can gain substantial financial success and status. The promise of easily gotten financial wealth and status has lured a flood of individuals, many of them young children, into the illegal drug trade. As a result of the multitudes who have turned to using or selling crack cocaine, the criminal justice system has become overburdened with drug-related cases.

To aid the criminal justice system in the war on crack cocaine and other drugs, many individuals, have shouldered the task of educating and deterring people away from drug-related lifestyles. A plurality of education tools have been devised to fight the war against drugs, some of which have taken the form of board games designed to educate people about the detrimental consequences of leading a drug related lifestyle.

For example, U.S. Pat. No. 5,139,268 issued to Garnett on Aug. 18, 1992, describes a board game for educating children about the consequences of drug use, comprised of a board having two concentric paths, an outer, longer path and an inner, shorter path. Players who choose the shorter path face pitfalls which can slow their progress, while players who choose the longer path are assisted in their travels when landing on "say no and go" spaces. In the center of the board is a drug free zone and the object of the game is for a player to get all of his tokens into the drug free zone.

U.S. Pat. No. 5,071,134 issued to Burroughs, Jr., on Dec. 10, 1991, describes a substance abuse board game apparatus and a method for playing the same. The board is comprised of a spiral pathway, having four concentric levels wherein a player at the first level is a phase-one substance abuser and the goal is to rise to the fourth level to become a substance abuse counselor. Various spaces upon the board represent penalty spaces and require the drawing of penalty cards. Additionally, various other spaces disposed upon the pathway require the drawing of question cards. The penalty cards and question cards are identified by a plurality of colors, wherein spaces having corresponding colors require the drawing of either a question card or a penalty card.

U.S. Pat. No. 4,216,966 issued to MacRae on Aug. 12, 1980, describes a board game for simulating drunken driving wherein a player can become more intoxicated as the game proceeds over a period of time. Three of cards indicate consequences to a player for landing on a road hazard playing location, while in a drunken state.

Additionally a police car is provided as a means of eliminating a drunken player from the game.

U.S. Pat. No. 4,962,934 issued to Taylor on Oct. 16, 1990, describes a board game relating to college experiences and representing the effects which drinking may have on success in college life and graduation therefrom. The playing board has a main path including successive playing positions further provided with a short-cut path from one side of the main path to the other, and a return path from the short-cut to a position on the main path intermediate the entrance and exit of the short-cut path. A plurality of cards corresponding with indicia upon the playing spaces on each path decide the fate of each player.

Additionally, a plurality of board games related to the criminal justice system and/or moral values exist. These games include U.S. Pat. No. 4,053,154, Niemann; 4,012,045, Vail; 3,977,680, Lavin; and 4,201,388, Cantelon.

While the previous board games have focused upon drug or alcohol abuse from the standpoint of the player assuming the role of the addict, none of the previous games have focused upon fighting drugs from the perspective of law enforcement. By allowing players to assume the role of a police officer, players would be introduced to the plight of the police fighting the drug war, thus allowing players to acknowledge the police as heroes and role models.

This aspect of recognizing the police as role models is especially important to children who are attracted to the drug trade and, who may already look upon drug dealers as positive role models. Therefore a need still exists for a drug awareness game which dismantles the myth of drug dealers as positive role models and which simultaneously supports the police as role models to be emulated.

The foregoing patents reflect the state of the art of which the applicant is aware and are tendered with the view toward discharging applicant's acknowledged duty of candor in disclosing information which mat be pertinent in the examination of this application. It is respectfully stipulated, however, that none of these patents teach or render obvious, singly or when considered in combination, applicant's claimed invention.

SUMMARY OF THE INVENTION

The present invention is both a board game apparatus designed for educating its players against the scourge of crack cocaine and its accompanying criminal lifestyle, as well as a method for playing the board game apparatus. Broadly, the board game apparatus, entitled "Crackhouse Crackdown", includes a playing board divided into four main regions having a continuous pathway which meanders through each of the four main regions. A start position and an end position are placed at opposite ends of the pathway, wherein the start position is placed adjacent to the first of the four main regions. In the first main region are a plurality of playing positions indicating "prerequisite items" which a player, assuming the role of a police officer, must obtain first, as prerequisites for gaining entrance into the other three main regions which comprise the playing board. These "prerequisite items" include a bullet proof vest, a police badge, armaments, a task force comprised of a plurality of police officers, and a search warrant.

The pathway present in the other three main regions has a plurality of playing positions containing indicia which indicate one of five things (1) the giving of instructions; (2) the giving of information which somehow affects the player's fate; (3) indicia which indicate that a card must be drawn (4) indicia designating a barricade which can only be crossed after the player acquires a police tool and (5) indicia indicating a neutral playing position, often containing an anti-drug message.

Additionally, the board game apparatus is preferably designed to have a playing board which can be colored by its players, thereby increasing the visual appeal of the game and allowing each player to add a sense of individuality to the playing board.

The board game apparatus also includes a police chart for monitoring each player's progress throughout the play of the game. The police chart includes a point chart which has a listing of point values awarded for convicting a plurality of criminals and confiscating a plurality of contraband items. An additional listing of point values on the point chart, displays amounts of points necessary to obtain a plurality of police tools which include a drug sniffing dog, a police helicopter, a crime lab, a police boat and a police tank. A series of grids on the police chart allow a player to monitor criminals convicted, contraband items captured, hostages taken, points won, police tools acquired and prerequisite items obtained. The point chart also has a grid for identifying the player as a police officer.

The board game apparatus also includes a first set of "guidance cards" for guiding a player's moves as the game progresses. The guidance cards must be drawn whenever a player lands on a playing position indicating the logo "Crackhouse Crackdown". The guidance cards contain either instructions or other information which a player must follow upon drawing the card.

A second set of "guilt determination" cards is also included in the board game apparatus, which allows a player to obtain convictions against any criminals which the player arrests. Upon arresting a criminal by landing on a playing position indicating that the player has arrested one or more criminals, or else by the player drawing a guidance card indicating the arrest of one or more criminals, the player next draws a number of guilt determination cards corresponding to the number of criminals arrested. The player then turns the guilt determination cards face up to reveal the words "innocent" or "guilty", thereby obtaining convictions, or setting the arrested criminals free. The board game apparatus also includes a plurality of game pieces, each player selecting a single game piece to represent his place in the game. A random number generator, which is preferably a pair of dice, serves as a means for determining the number of playing positions each player must advance his corresponding game piece with each turn.

The method of playing the board game apparatus includes each player first assuming the role of a police officer by recording his name, and badge number at a location indicated upon the police chart, with the object of the game being to convict a master criminal residing at the end position. Next, each player positions a corresponding game piece on the start position and upon obtaining a number from the dice, moves his game piece, in player turn, a number of playing positions along the pathway into the first main region as indicated by the dice. Each player must then remain in the first main region until he acquires the plurality of "prerequisite items" discussed previously. These items are obtained by rolling the dice and moving each game piece to playing positions in the first main region which indicate prerequisite items. The prerequisite items are necessary for a player to obtain success in the hostile environment existing in the other three main regions. Without the prerequisite items, a player has almost no chance of surviving the game.

Once a player has obtained all the required prerequisite items he may then leave the first main region and advance his game piece into one of two main regions adjacent to the first main region. A player must advance his game piece in a single direction along the pathway and may not change directions, except upon encountering a barricade position, or upon encountering a playing position which directs the player to reverse directions. Upon encountering such a barricade position, the player must reverse directions, unless he has a police tool, such as a boat or a tank to penetrate the barricade position. Police tools must be purchased with points acquired by each player.

Points for purchasing police tools are acquired any one of three ways: (1) When a player lands on a playing position which indicates on its face that the player has arrested one or more criminals or else has confiscated specified contraband items; (2) When a player lands on a playing position which requires that a guidance card be drawn, and the card indicates that the player has arrested one or more criminals or else has confiscated specified contraband items; or (3) When a player lands on a playing position indicating bonus points. Note that when a player arrests criminals, he does not acquire points immediately; points are acquired only upon drawing guilt determination cards indicating "guilty", thereby indicating the conviction of the arrested criminal. Criminals who have an "innocent" card drawn from the guilt determination deck are set free.

In the second, third and fourth main regions, a series of perils reminiscent of the day to day realities of crime fighting await each player. These perils are indicated upon the face of the playing positions or else upon the face of guidance cards which are to be drawn whenever a player lands on a playing position bearing the "Crackhouse Crackdown" logo. Each peril somehow affects the player's fate and these perils can range in seriousness from a player merely being instructed to return to the police station to receive a verbal reprimand from the chief, to a player being eliminated from the game. Players can also lose one or more prerequisite items and therefore be left more vulnerable to criminals and other perils. Players can be killed or wounded by being shot or injured by a variety of methods. A dead player must retire his game piece and obtain another game piece and police chart and return to the start position to continue playing the game. A wounded player must take respite in a hospital holding zone for one or more turns as indicated and upon "healing" his wounds, may return to the game.

Throughout the game, a player must monitor his progress on the police chart which has grids for indicating criminals convicted, contraband items confiscated, prerequisite items acquired, police tools acquired, and bonus points obtained. The monitoring function of the police chart is meant not only to tally points necessary for obtaining police tools, but also to monitor the conviction of three assassins and ten small-time criminals who must be convicted before obtaining entrance into the lair of the master criminal who resides at the end position. In addition, the monitoring function of the police chart allows a player to keep track of his prerequisite items and upon losing a prerequisite item, a player is wise to return to the first main region to regain the lost item so that he may have a better chance of reaching the end position and convicting the master criminal.

Upon obtaining access to the end position a player must still draw a final guilt determination card to obtain a conviction against the master criminal. If a "guilty" card is revealed, the player obtains a conviction and wins the game; if an innocent card is revealed, the player must allow the master criminal to be set free and the player must return to the start position to begin the game again.

This game may be played by a group of players or by a single player. This is possible, since a player is competitive against both the other players and against the criminals encountered. Because the game itself supplies its own competition, it is not necessary for a single player to have other players to play the game.

An object of the invention is to provide a game which fosters the police as role models.

Another object of the invention is to provide a game which illustrates the negative effects on the individual and society of crack cocaine.

Another object of the invention is to provide a game which supplies its own competition and therefore can be played in an engaging manner by a single player.

Another object of the invention is to provide a game wherein a player is dependent on an accompanying task force of other officers in order to achieve the ultimate goal of convicting a master criminal.

Still another object of the invention is to provide a game which portrays the frustration as well as the victories encountered by an officer fighting the war against crack cocaine.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 3A shows schematic representations of guidance cards used in playing the apparatus of the present invention.

FIG. 3B shows schematic representations of guidance cards used in playing the apparatus of the present invention.

DESCRIPTION OF THE PREFERRED EMBODIMENTS

Figure 1:
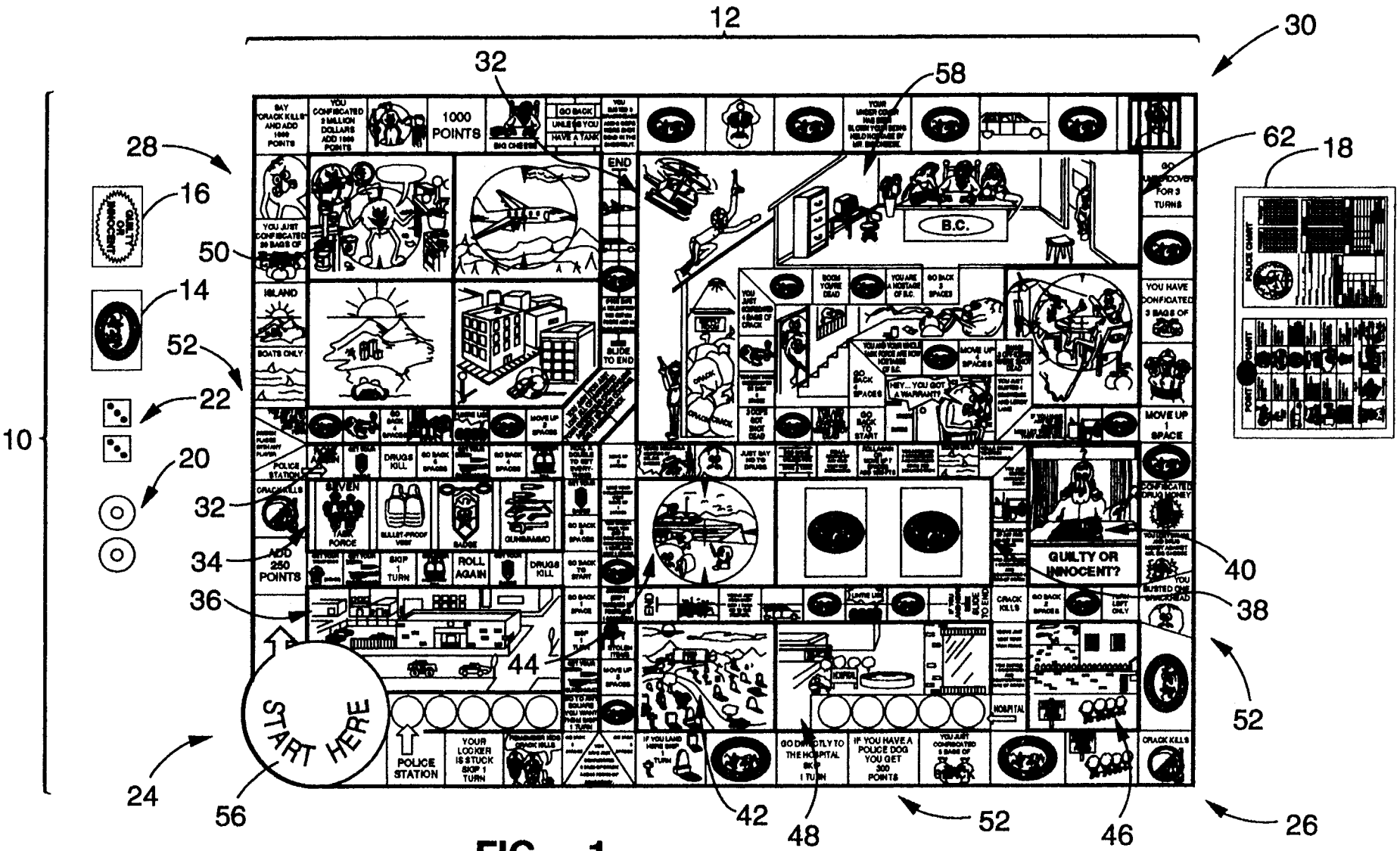
FIG. 1 is a plan view of the board game apparatus of the present invention.

Referring more specifically to the drawings, for illustrative purposes the present invention is embodied in the board game apparatus 10, generally shown in FIG. 1 and the method disclosed herein. It will be appreciated that the apparatus 10 and method disclosed herein may vary as to configuration and as to details irrespective of the parts, format, or media to which the apparatus 10 or method are applied, without departing from the basic concepts as disclosed herein.

THE BOARD GAME APPARATUS

Referring to FIG. 1, FIG. 2A, FIG. 2B, FIG. 2C, and FIG. 2D, the board game apparatus 10 of the present invention includes the playing board 12, a set of guidance cards 14, a set of guilt determination cards 16, a point chart 18, one or more game pieces 20 and a random number generator which, is a pair of dice 22 in the preferred embodiment.

The playing board 12 is preferably divided into a first main region 24, a second main region 26, a third main region 28 and a fourth main region 30. The four main regions 24, 26, 28 and 30, are separated by a dividing means 32 which serves as a visible obstacle which cannot be crossed by a player. The four main regions 24, 26, 28 and 30 include a plurality of subregions disposed at various locations represented by the numerals 34, 36, 38, 40, 42, 44, 46, 48 and 50. A pathway 52 containing a plurality of side-by-side shapes designating playing positions such as, 54A, 54B, 54C, 54D, 54E, 54F, 54G, 54H, 54I, 54J, 54K, 54L, 54M, and 54N, meander throughout the four main regions 24, 26, 28 and 30. Pathway 52 preferably has two ends, wherein a start position 56 delineates one end and an end position 58 delineates an opposite end.

In the preferred embodiment, start position 56 is included within first main region 24, immediately adjacent to pathway 52 therein. Start position 56 preferably located in such a manner, since a player must be able to leave start position 56 and have immediate access to a plurality of playing positions 54A indicating prerequisite items, which must be acquired by a player prior to advancing into the other three main regions 26, 28, and 30. In the preferred embodiment, prerequisite items include a police task force, a bullet proof vest, armaments, a police badge, and a search warrant. Additionally, a plurality of playing positions 54B provide a separate location apart from playing positions 54A wherein a player can obtain one or more prerequisite items. For example, playing positions 54A and 54B could be organized such that playing positions 54A designate locations for obtaining a police task force, a bulletproof vest, armaments and a police badge and playing positions 54B could be designated as the location from where a player could obtain a search warrant.

First main region 24 preferably includes a plurality of additional playing positions 54C indicating instructions which can affect a player's movements while playing the game. Examples of such instructions are: "Go Back To Start"; "Roll Again", "Go To Any Square, Then Skip One Turn", or the like.

Additionally, first main region 24 may preferably include a plurality of playing positions 54D designated as neutral positions which have no real effect on a player's movements in the game, but which carry indicia indicating various anti-drug messages such as "Crack Kills" or "Drugs Kill", or the like.

First main region 24 preferably includes two subregions 34 and 36 within its confines. First subregion 34 may include a representation of the task force, bullet proof vest, armaments, and police badge prerequisite items displayed in "poster board" format. First subregion 34 may carry no function other than to supply the player with a visible reminder of the prerequisite items which must be acquired before advancing into the other three main regions 26, 28 and 30.

Additionally, second subregion 36 may serve as a location for containing playing positions 54B, as discussed previously, wherein a player might obtain an additional prerequisite item 60. In the preferred embodiment, second subregion 36 represents a police station having an entry way leading to five playing positions 54B. A player must enter the police station and upon entering, may land on any of the five playing positions 54B to obtain the additional prerequisite item.

Pathway 52 in first main region 24 preferably communicates with the pathways 52 present in the two adjacent second 26 and third 28 main regions, giving a player the option of advancing into one of the two adjacent main regions 26 and 28, upon obtaining all the prerequisite items from first main region 24.

Figure 2A:
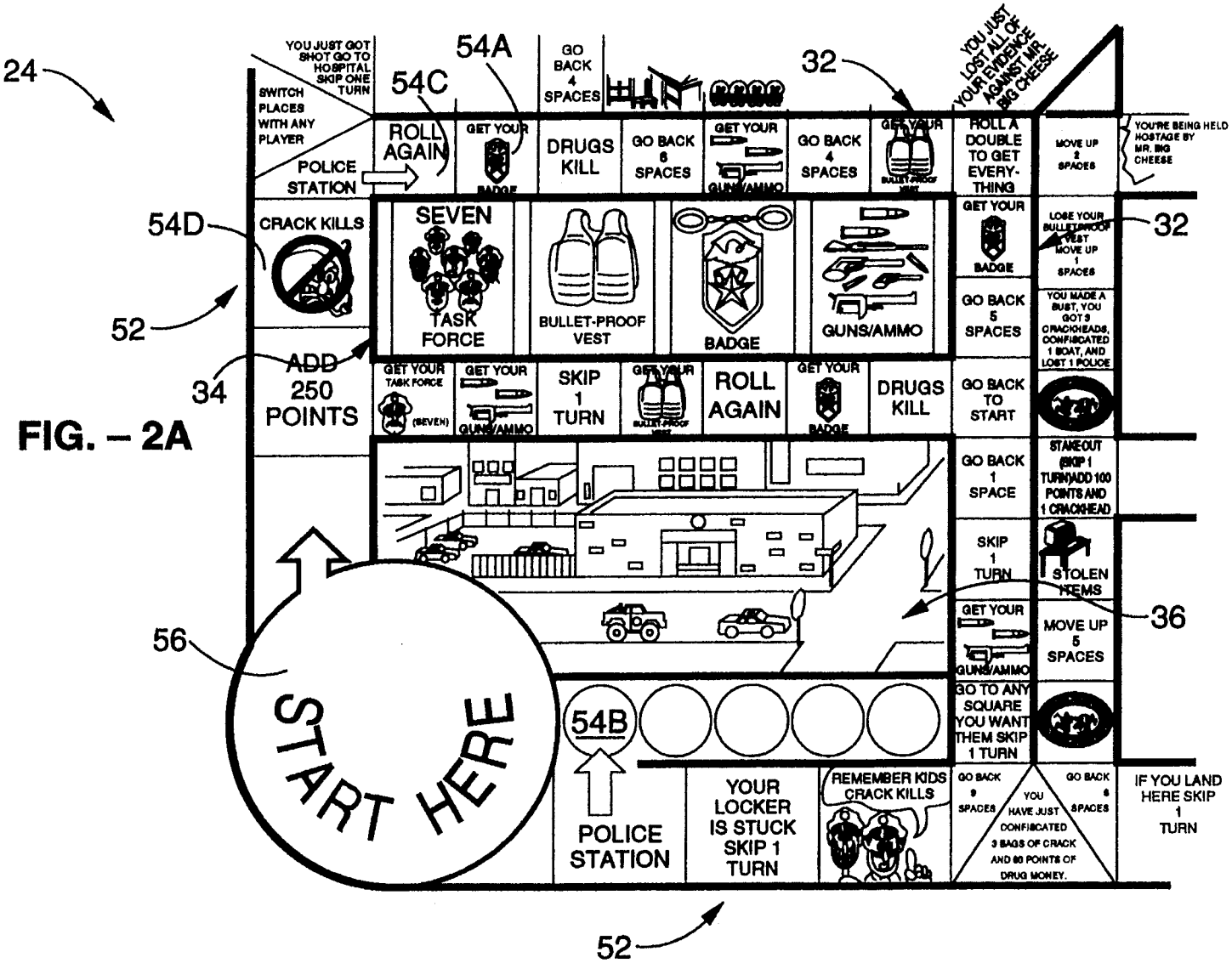
FIG. 2A is a plan view of the first main region of the playing board of the apparatus of the present invention.
Figure 2B:
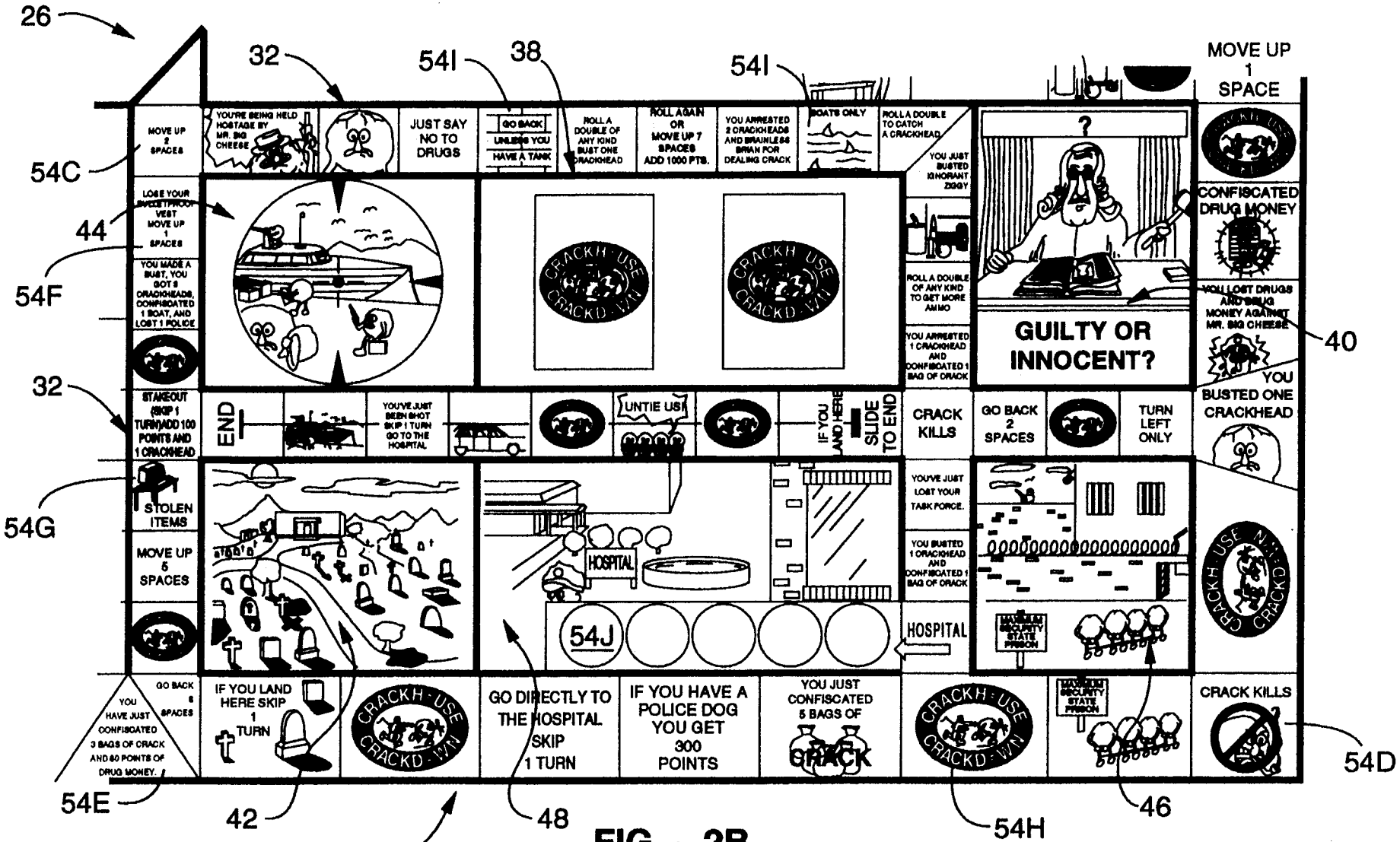
FIG. 2B is a plan view of the second main region of the playing board of the apparatus of the present invention.
Figure 2C:
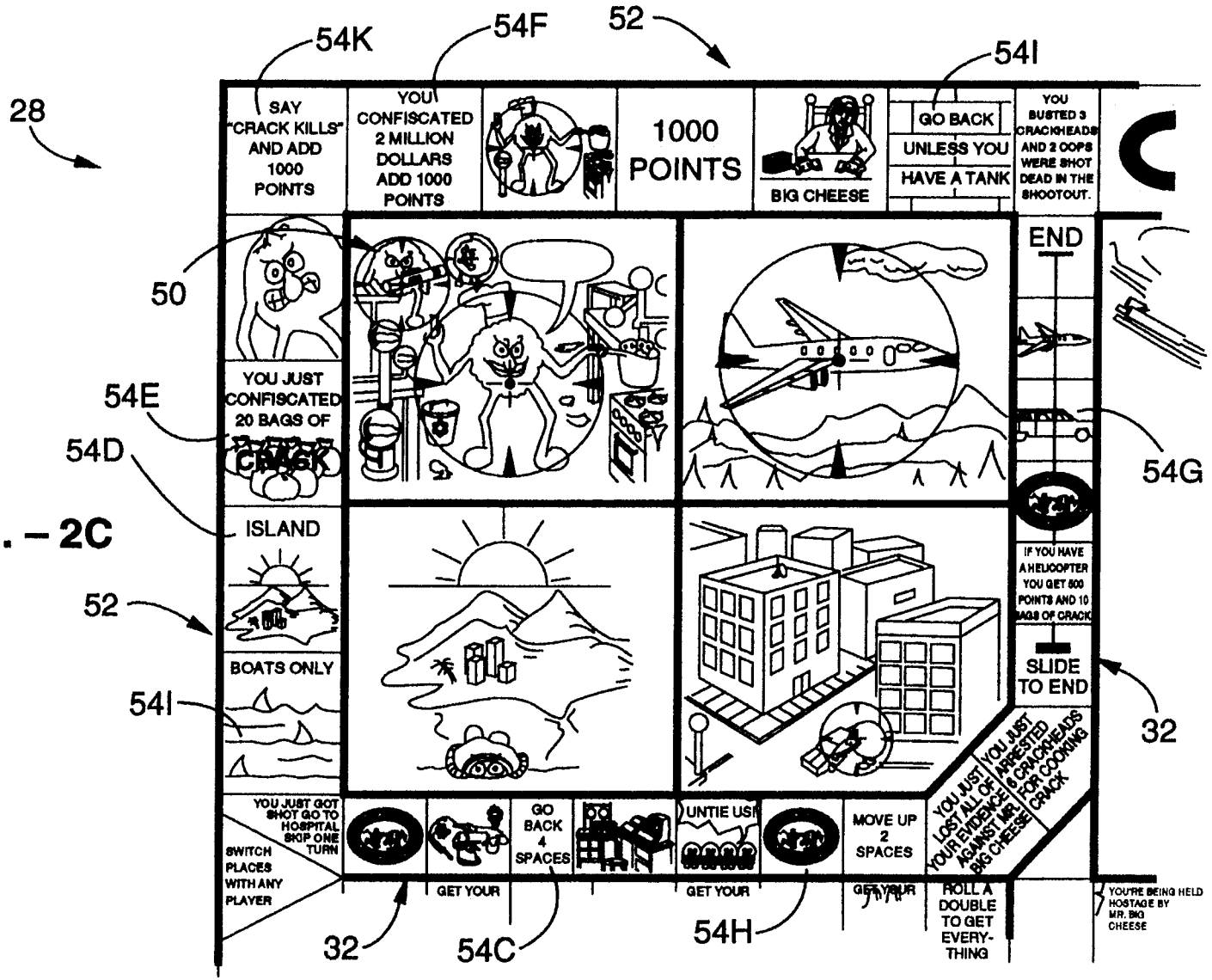
FIG. 2C is a plan view of the third main region of the playing board of the apparatus of the present invention.

Still referring to FIG. 1 and also referring more closely to FIG. 2B and FIG. 2C, second 26 and third 28 main regions are shown, respectively. Fourth main region 30 preferably does not communicate with first main region 24 by way of pathway 52. Second 26 and third 28 main regions, as well as fourth main region 30, have playing positions designed to simulate the hostile street environment encountered by the typical police officer. By having to endure the second 26 or third 28 main regions before reaching fourth main region 30, which includes end position 58, it is hoped a player will come to appreciate the dangers encountered by a police officer in his/her daily work.

Similarly to first main region 24, second main region 26 has a plurality of playing positions 54C indicating instructions thereon. By way of example and not of limitation second main region 26 may include playing positions 54C having instructions such as "Move Up 2 Spaces"; "If You Land Here, Skip One Turn"; "Go Directly To The Hospital, Skip One Turn", or the like.

Additionally, a similar plurality of neutral playing positions 54D as seen in first main region 24 exist in the second main region 26. These neutral playing positions 54D may carry an anti-drug message such as "Crack Kills" or else contain an illustration meant to deter a player from involvement with drugs, such as an illustration of a prison.

Second main region 26 also has a plurality of playing positions 54E not evident in first main region 24 which provide information, as opposed to instructions, which can nevertheless affect a player's progress while playing the game. For example these type of playing positions 54E provide information such as "Lose Your Bullet proof Vest"; "You Just Busted One "Crackhead""; "You Have Just Lost Your Task Force"; "You Have Just Confiscated 3 Bags Of Crack And 60 Points Of Drug Money", or the like.

Additionally, there may be a plurality of playing positions 54F which combine both instructions and information such as "Lose Your Bulletproof Vest, Move Up One Space"; "Roll A Double Of Any Kind To Get Ten "Crackheads"", or the like.

A plurality of playing positions 54G also indicate contraband items, which, in the preferred embodiment, include a plurality of stolen items, stolen limousines, the master criminal's drug plane, the master criminal's drug boat, explosives, a crack lab, drug money, and bags of crack. These contraband items are preferably indicated by an illustration of the particular contraband item present on the playing position 54G.

Also in the second main region 26 are a plurality of playing positions 54H displaying the "Crackhouse Crackdown" game logo. Referring additionally to FIG. 3A and FIG. 3B, when a player lands on such a playing position 54H, the player is required to draw a guidance card 14 which bears a similar "Crackhouse Crackdown" logo on a one of its faces and, additionally, bears information, instructions, or anti-drug messages on an opposite face. Upon drawing a guidance card 14, a player merely has to follow the instructions or information indicated by the card.

Figure 4:
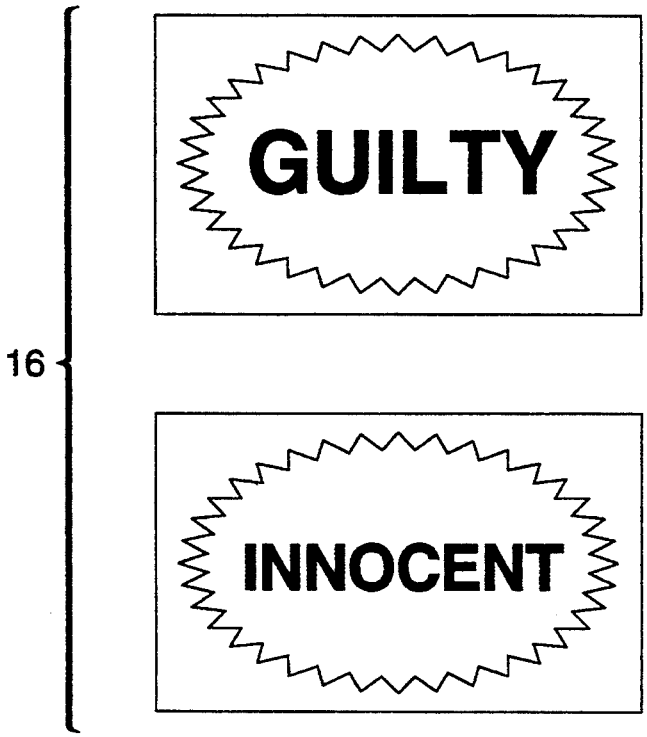
FIG. 4 shows schematic representations of guilt determination cards used in playing the apparatus of the present invention.

A second set of "guilt determination" cards additionally shown in FIG. 4, are included in the board game apparatus 10 of the present invention, which are to be used whenever playing position similar to 54C, 54E, or 54F, or a guidance card 14 drawn after landing on playing position 54H, indicates that a player has arrested any one of a plurality of criminals in the game. The criminals range in a preferred hierarchy, from "Mr. Big Cheese", the master criminal, to Mr. Big Cheese's assassins "Brainless Brian", "Ignorant Ziggy", and "Jack Crack"0 and, finally, to a plurality of small-time crack cocaine users know collectively as "Crackheads".

The objective of the game is for the player in the role of a police officer to survive the rigors of the street long enough to confiscate as many contraband items as possible and to convict as many of the aforementioned criminals, with the ultimate goal being to obtain a conviction against Mr. Big Cheese, the master criminal. The guilt determination cards 16 which indicate "guilty" or "innocent" on one of their faces allow a player to obtain convictions against any one of the aforementioned criminals, by obtaining a "guilty" card, or alternatively endure the frustration of seeing an arrested criminal set free upon obtaining an "innocent" card. The guilt determination cards 16, therefore simulate the real-life victories and frustrations encountered by a police officer who must take his chances with the criminal justice system, upon arresting criminals.

In operation, when a player lands on playing position similar to 54E which states, for example "You've Just Busted Five Crackheads", the player must then draw five guilt determination cards 16 to determine the guilt or innocence of the arrested criminals. Likewise, upon landing on a playing position 54H bearing the "Crackhouse Crackdown" logo, and upon further drawing a corresponding guidance card 14 which states, for example, "If You Have A Task Force And A Search Warrant, Bust The Crack Lab and Add Three Crackheads", you must additionally draw three guilt determination cards 16 to determine the guilt or innocence of the three arrested criminals.

Figure 5:
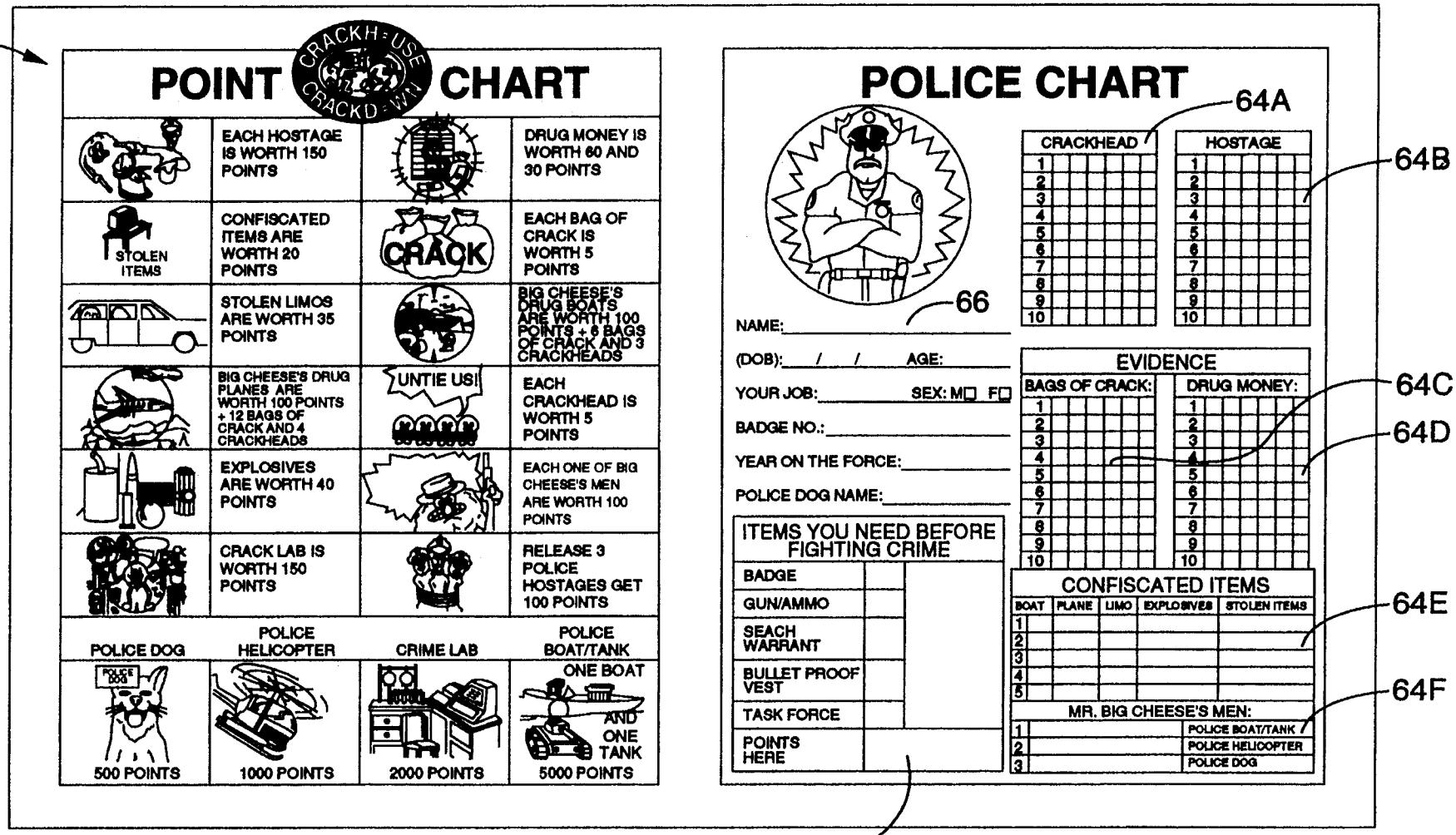
FIG. 5 is a plan view of the police chart of the apparatus of the present invention.

Referring again to FIG. 2B and also to FIG. 5, second main region 26 also preferably includes a barricade position 54I, which indicates some type of natural or man-made obstacle to a player's progress along the game pathway 52. To cross a barricade position 54I, a player must have the appropriate police tool. For example, in the preferred embodiment, the barricade position 54I is represented by a brick wall or a shark-infested expanse of water, which, can only be penetrated by a police tool such as a police tank or a police boat, respectively. Point chart 60 of police chart 18 illustrates a plurality of police tools which include a police dog, a police helicopter, a crime lab a police boat and a police tank. If a player has not acquired the requisite amount of points needed to purchase these police tools, the player must, upon encountering barricade position 54I, reverse the direction of his game piece 20 and take an alternate pathway 52 around barricade position 54I. Normally, a player's game piece 20 must travel in a single direction along pathway 52; it is only upon encountering barricade position 541 that a player is allowed to alter the direction of his game piece 20.

In the preferred embodiment, two barricade positions 54I are placed on either side of one or more playing positions indicating information designating bonus points or the arrest of the master criminal, or some other monumental event. Hence, for example, a player having the proper police tool can obtain additional points or else convict the master criminal and win the game upon penetrating the barricade positions 54I.

Second main region 26, similarly to first main region 24 also preferably contains a plurality of subregions 38, 40, 42, 44, 46 and 48. In the preferred embodiment, these subregions 38, 40, 42, 44, 46 and 48 may provide spaces 38 for the placement of guidance cards 14 or spaces 40 for the placement of guilt determination cards 16, or alternatively, provide for a plurality of holding zones 42, 44, 46 and 48 represented by a cemetery holding zone 42, a shipyard holding zone 44, a prison holding zone 46 and a hospital holding zone 48 in the preferred embodiment. The holding zones 42, 44, 46 and 48 previously described, are used in conjunction with playing positions similar 54C, 54E, or 54F, or guidance cards 14, which may instruct, for example "You've Just Been Shot, Skip One Turn, Go To The Hospital", or the like. The holding zones 42, 44, 46 and 48 serve as temporary or permanent penalty zones whenever a player lands on a playing position or draws a guidance card 14 instructing the player to spend all or part of the remainder of the game in a holding zone 42, 44, 46, or 48. The hospital holding zone 48 may preferably have a plurality of playing positions 54J for placing game pieces 20 of players confined within the hospital holding zone 48. Playing positions 54J also perform an aesthetic function by lending a symmetry to playing board 12 by balancing playing positions 54B in the second subregion 34 of the first main region 24.

The third main region 28 as seen in FIG. 1 FIG. 2C, preferably has a pathway 52 communicating with both the pathways 52 of the adjacent first 24 and fourth 30 main regions. Playing positions 54C, 54D, 54E, 54F, 54G, 54H, and 54I, present on the pathway 52 of the third main region 28, are substantially similar to those in second main region 26 previously described, in that they may include instructions, information, barricade positions, bonus points, "Crackhouse Crackdown" indicia requiring the drawing of a guidance card 14, or the like.

However, in the preferred embodiment, the pathway 52 of the third main region 28 differs substantially from the portion of pathway 52 in second main region 26, through the addition of an extended section of pathway 52 protected at its opposite ends by two barricade positions 54I. This section contains an interactive playing position 54K which requires a player landing on interactive playing position 54K to state "Crack Kills" as a prerequisite to obtaining bonus points. The requirement that a player state "Crack Kills" helps reinforce to all players involved in playing the present invention, the detrimental consequences of becoming involved with crack cocaine.

The third main region 28 also has a plurality of subregions 50 within its confines which include illustrations of drug trafficking, such as planes transporting contraband items, dealers selling crack, drug labs, tropical islands containing the master criminal's illegal offshore accounts, or the like.

Figure 2D:
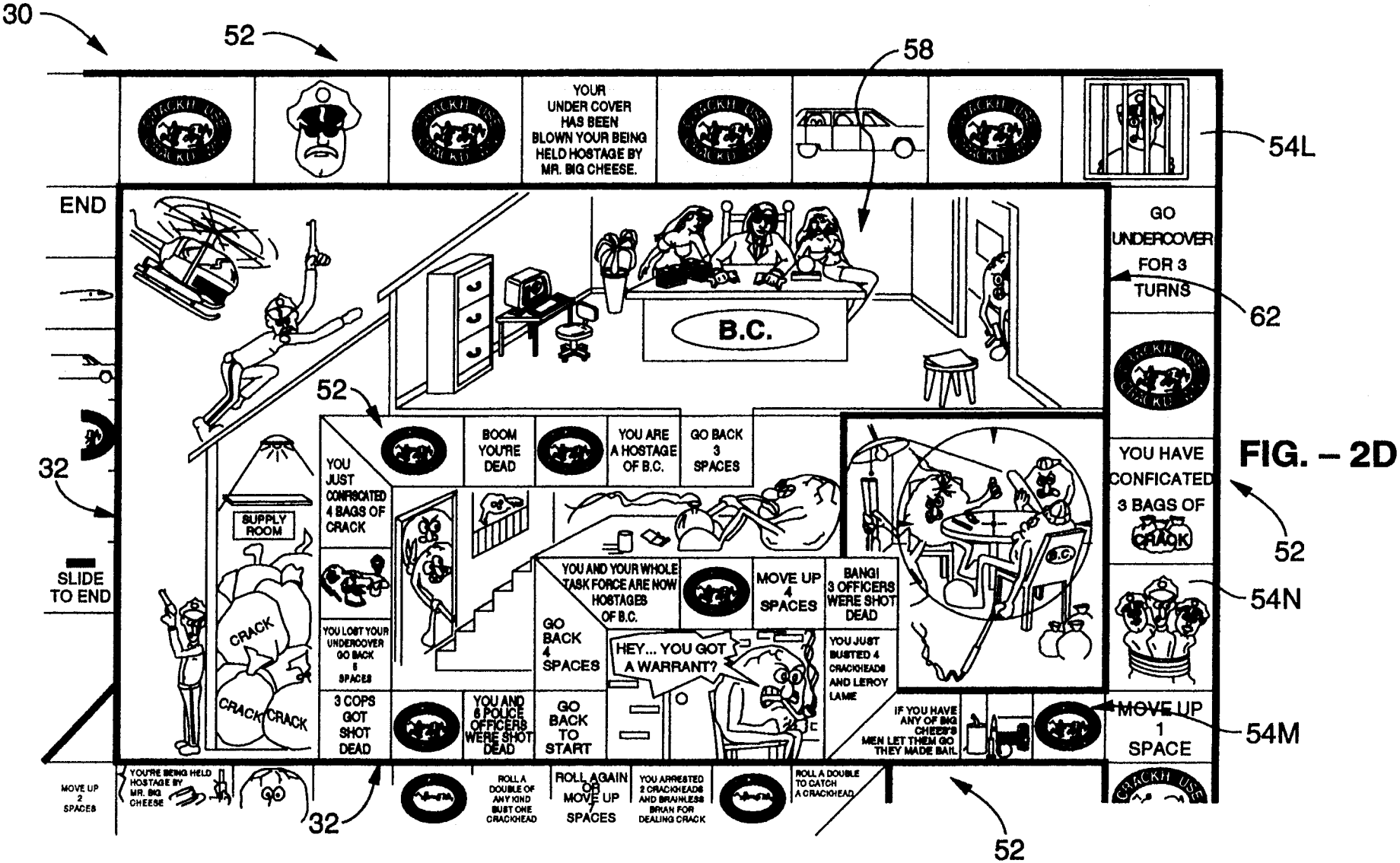
FIG. 2D is a plan view of the fourth main region of the playing board of the apparatus of the present invention.

Referring to FIG. 1 and FIG. 2D, fourth main region 30 preferably includes a pathway 52 which communicates with pathway 52 in the adjacent second 26 and third 28 main regions, the pathway 52 in the fourth main region 30 being substantially similar to the pathway 52 present in the second 26 and third 28 main regions. However, the fourth main region 30 includes a playing position designated as a "Hostage Holding Cell" 54L where police officers are held hostage by the master criminal until freed by other players. Hostage Holding Cell 54L therefore adds a cooperative element to the game, as individual players can help each other gain freedom from Hostage Holding Cell 54L . Additionally, a player can roll a double of any number to free himself from the Hostage Holding Cell 54L.

Pathway 52 in fourth main region 30 extends into a subregion which includes the end position 58 marking the termination of pathway 52. This subregion denotes the master criminal, Mr. Big Cheese's, lair 62. The beginning of the master criminal's lair 62 is denoted by playing position 54M. Before advancing onto playing position 54M, a player must have already convicted ten "Crackheads" and the master criminal's three assassins.

Playing position 54N, near the entrance of the master criminal's lair 62 preferably includes an illustration of three police officers tied-up with a rope. Playing position 54N allows a player to add these three officers to his seven-man task force for a total of ten officers maximum. These additional officers are often needed, since the pathway 52 advancing into the master criminal's lair 62 is preferably extremely hazardous to a player's task force and other prerequisite items. Because of the added danger present on this final section of pathway 52, one or all of a player's prerequisite items can become lost or destroyed, thus exposing a player to being completely eliminated from the game.

The master criminal resides on the end position 58 marking the terminus of the game pathway 52. Upon landing upon end position 58, a player must draw a final guilt determination card 16; a "guilty" card resulting in the conviction of the master criminal and therefore, a win for the player and an "innocent" card resulting in the player having to return to the start position 56 to begin the game again.

Additionally, the board game apparatus 10 is preferably designed to have a playing board 12 which can be colored by its players, thereby increasing the visual appeal of the game and allowing each player to add a sense of individuality to playing board 12.

Referring to FIG. 5, the police chart 18 represents the final component of a complete board game apparatus 10. The police chart 18 includes point chart 60 revealing the point values of the plurality of contraband items and criminals, discussed previously. Additionally, point values required for purchasing the plurality of police tools discussed previously, are indicated on the point chart 60. All point values shown in FIG. 5, were chosen arbitrarily for illustration purposes only.

Additionally, police chart 18 includes a plurality of grids 64A, 64B, 64C, 64D, 64E, 64F and 64G for allowing a player to monitor the amounts of contraband items confiscated, the amounts of criminals convicted, the amounts of police tools acquired, the amounts of bonus points obtained, the amounts of hostages taken and the amount of prerequisite items acquired. Monitoring these items allows a player to easily determine whether he has acquired the requisite amount of points to purchase a police tool and also to determine if he has convicted a minimum of ten "Crackheads" and all three of the master criminals assassins, so that the player can gain entrance onto the pathway 52 leading into the master criminal's Lair 62 in the fourth main region 30.

Finally, police chart 18 has an identification space 66 for allowing a player to identify himself as a police officer, or other law enforcement figure. By assuming the identity of a police officer, a player is allowed to gain a first-hand perspective of a police officer fighting the war on crack cocaine.

PLAYING IN THE FIRST MAIN REGION

Referring to FIG. 1, FIG. 2A, and FIG. 5 the method for playing the board game apparatus 10 can be illustrated. The method of playing the board game apparatus 10 of the present invention, begins by each player acquiring a game piece 20, and a police chart 18. Upon identifying themselves in identification space 66 on police chart 18 as police officers, the players roll dice 22 one time each, to obtain the highest number possible. The player with the highest roll begins the game first, and players with successively lesser rolls follow in turn. The sequence of player's turns established by these initial rolls of the dice 22 is to be followed throughout the game, unless otherwise indicated.

Each player places a corresponding game piece 20 on start position 56 and upon rolling dice 22, advances a number of playing positions according to the number indicated by dice 22, into first main region 24. Each player must move his game piece 20 in a single direction throughout the entire game. Additionally referring to FIG. 2B, a player may only reverse directions upon encountering a barricade position 54I and being unable to cross it, for lack of owning the proper police tool. The players then roll their dice 22 in player turn, to advance around pathway 52 in first main region 24, with the goal in first main region 24 being to land their playing pieces 20 on all of the playing positions similar to 54A or 54B which indicate prerequisite items. If a player rolls a double of any number at any point in the game, the player gets a second turn. The players may not always be successful with each turn at landing on a playing positions indicating a prerequisite item and may, instead, land on a playing position indicating an instruction, or information, or neutral playing positions carrying anti-drug messages. By way of example and not of limitation, the following playing positions are typically found in first main region 24 and upon landing on the particular playing position described below, the player must take the following actions:

If a player lands on a playing position indicating the prerequisite items of a task force, bulletproof vest, armaments, search warrant or a police badge, the player must add each prerequisite item to grid 64G on police chart 18 and upon obtaining all five items, the player may advance into second 26 or third 28 main region. A player may acquire up to two guns by landing twice on playing positions indicating armaments, however, a player may only acquire one of each of the other four prerequisite items. The prerequisite items are required for allowing a player to do the following:

TASK FORCE—Each player is allowed a seven-man task force. It is also possible for a player to obtain another three men for a total of a ten-man task force. If a player loses his entire task force, he must move his game piece 20 to a playing position indicating a task force in first main region 24 to obtain another task force.

BULLETPROOF VEST—Each player must have a bulletproof vest to endure being shot by a criminal. Upon being shot, a player loses his bulletproof vest and must move his game piece 20 to a playing position indicating a bulletproof vest in first main region 24 to obtain another bulletproof vest.

ARMAMENTS/GUNS N AMMO—Each player must have a gun to be able to arrest any criminals in the game. A player may acquire up to two guns by landing on two playing positions which indicate armaments. If a player loses all his guns, he must move his game piece 20 to a playing position indicating armaments in first main region 24 to obtain another gun.

POLICE BADGE—Each player must have a police badge to be able to identify himself as a police officer and to thereby arrest any criminals in the game. If a player loses his badge, he cannot arrest criminals and must move his game piece 20 to a playing position in first main region 24 which indicates a police badge to obtain another.

SEARCH WARRANT—Each player must have a search warrant before he can gain entry to the end position 58 to arrest Mr. Big Cheese. If a player loses his search warrant, he must move his game piece 20 to any one of the five playing positions 54B in the second subregion 36 to obtain another.

In an alternate embodiment, rather than upon losing a prerequisite item, having a player move his game piece 20 directly back to a playing position containing the lost prerequisite item, it is contemplated, that a player must, instead, follow pathway 52 the entire way back to the playing position containing the desired prerequisite item.

If a playing position instructs or informs a player to "Go Back 1 Space"; "Go Back 6 Playing positions"; "Go Back 5 Playing positions"; "Go Back 4 Playing positions"; "Skip One Turn"; "Go To Any Square You Want . . . Then Skip One Turn"; "Go Back To Start"; "Your Locker Is Stuck, Skip One Turn"; "Get A Warrant At The Station", the player must follow the instructions or information indicated on these playing positions.

If a playing position instructs a player to "Roll Again" the player must roll the dice 22 again and move his game piece the corresponding number of playing positions indicated by the dice 22.

If a playing position instructs a player to "Roll A Double To Get Everything", the player must roll a double of any number to obtain all the prerequisite items. If the player is successful in rolling a double, the player must add all five items to grid 64G on his police chart 18. Upon acquiring all five prerequisite items, the player may then advance into the second 26 or third 28 main regions If a playing position instructs a player to "Add 150 Points", the player must add the indicated number of points to grid 64G on his police chart 18.

If a playing position indicates the anti-drug message "Drugs Kill" or "Crack Kills", the player must spend his turn pondering the anti-drug message indicated.

PLAYING IN THE SECOND, THIRD AND FOURTH MAIN REGIONS

Referring additionally to FIG. 2B, FIG. 2C, FIG. 2D, FIG. 3A, FIG. 3B and FIG. 4, the method of play in the second 26, third 28 and fourth 30 main regions may be examined. Upon acquiring the necessary plurality of prerequisite items, a player is free to advance into either the second 26, third 28 and eventually, the fourth 30 main regions. The second 26, third 28 and fourth main 30 regions have a three-fold function: (1) To allow a player to understand the day to day struggle of a police officer fighting the war on crack cocaine and (2) To afford a player the opportunity to gain points to purchase a plurality of police tools and (3) to capture a required number of ten "Crackheads" and three of the master criminal's assassins, "Jack Crack", "Brainless Brian" and "Ignorant Ziggy" so that a player can advance into the master criminal's lair 62 and convict the master criminal residing at end position 58.

Referring also to FIG. 5, point chart 60 illustrates point values which can be acquired as well as various police tools which can be purchased upon acquiring a requisite amount of points. By gaining the requisite amount of points to purchase a police tool, a player is suddenly afforded a great advantage over competing players as well as against the various criminal characters present in the game. A police tool allows a player to gain even more points by making it easier to arrest criminals or break through barricade positions to gain access to bonus points. By being able to more rapidly arrest criminals, a player will more rapidly acquire the requisite ten "Crackheads" and three assassins necessary for gaining access into the master criminal's lair 62.

Points for acquiring police tools can be obtained by one of three ways: (1) Obtaining convictions against "Crackheads" or against the master criminal's 3 assassins; convictions are obtained by selecting "guilty" guilt determination cards 16; "innocent" guilt determination cards 16 set the corresponding criminal free, (2) Acquiring contraband items by landing on a playing position indicating contraband items. The types of contraband items are: confiscated items/property, stolen limousines, the master criminal's drug plane, explosives, crack labs, drug money, bags of crack, the master criminal's drug boat, or (3) Landing on a playing position indicating information regarding bonus points; these playing positions may indicate "Get 1000 Points", or the like, and are often protected by barricade positions which require a police tool to penetrate.

Point values assigned to convicted criminals, confiscated contraband items, and bonus points are completely arbitrary and, point values may be selected based on criteria which allows the game to be quickly and efficiently played. Each time a player confiscates contraband items, convicts a criminal, or obtains bonus points, the player must record each of these events on the appropriate grid 64A, 64B, 64C, 64D, 64E or 64F on his police chart 18. Periodically, the player must convert convicted criminals and confiscated contraband items to their corresponding point values indicated on police chart 18 and add these points to any bonus points obtained. The player must then tally his total points to determine if he has obtained the requisite amount of points necessary to purchase a police tool.

It is also possible to lose points as the game proceeds. Points may be lost whenever a player is placed in the Hostage Holding Cell 54L in fourth main region 30, by the various criminals in the game. Point chart 60 indicates the value of a hostage, which must be subtracted from the player's point tally. A player may obtain freedom from being a hostage when a second player lands on the Hostage Holding Cell 54L or else when the first player rolls a double of any number. Upon obtaining freedom, the freed player does not add back the points which he subtracted, he is merely freed to continue the game. If the first player is freed by a second player, the second player gets points for freeing the first player and does not become a hostage himself. The possibility of obtaining points acts as an incentive for the second player to free the first player. If the game is being played by a single player, the only way the single player can obtain freedom is to roll a double of any number. In an alternate embodiment, it is also contemplated that there be various "Civilian Hostages" wherein a player, upon landing on Hostage Holding Cell 54L, frees numerous "Civilian Hostages", rather than becoming a hostage himself. In this alternate embodiment, the player who frees the "Civilian Hostages" would add points for each "Civilian Hostage" freed.

Points must also be subtracted if any of a player's convicted criminals escape, or make bail, or avoid their convictions in some other way. Points are not subtracted upon drawing "innocent" guilt determination cards 16 against arrested criminals. Also, points must be subtracted if any contraband items are lost or fall back into criminal hands.

The points acquired during the game, as stated previously, are intended to purchase/acquire police tools. Upon purchasing a police tool with his acquired points, a player does not subtract the corresponding points required for the purchase from his total point tally. The acquired points remain in the point tally so that the player may acquire other police tools, In the preferred embodiment, the point values required to purchase a police tool increase from one police tool to the next, so that when one police tool is obtained, the player can increase his tally to obtain the next police tool, and so on. The police tools include a police boat, a police dog, a police helicopter, a police tank and a crime lab, wherein each tool is capable of performing the following functions:

POLICE DOG—A police dog can "sniff out" and confiscate any bag of crack within five playing positions in any direction of a playing position occupied by a player's game piece 20. A player owning a police dog must announce that he is going to use it prior to rolling the dice 22 and a player can only use his police dog once every two turns.

POLICE HELICOPTER—A police helicopter can arrest any "Crackhead" up to five playing positions away from the playing position occupied by the game piece 20 of the player owning the helicopter. Guilt determination cards 16 must be drawn to obtain convictions against the arrested "Crackheads". A player can use the helicopter on any turn.

CRIME LAB—A crime lab can arrest "Crackheads" and confiscate bags of crack for up to ten playing positions away from the playing position occupied by the game piece 20 of the player owning the crime lab. A player may use the crime lab on any turn.

POLICE BOAT—A police boat allows a player to penetrate a barricade position indicating "Boats Only". On the opposite side of such a barricade position are usually playing positions indicating bonus points. A police boat may only be used upon encountering such a barricade position.

POLICE TANK—A police tank can penetrate a barricade position indicating "Go Back Unless You Have A Tank". A police tank may only be used upon encountering such a barricade position.

Referring closely to FIG. 1, FIG. 2B, and FIG. 5, the method of play in second main region 26 can be examined. While advancing through second main region 26, a player will encounter a plurality of playing positions along pathway 52 which instruct or inform him to take various actions. By way of example and not of limitation, the following playing positions indicating the following items, are typically found in second main region 26 and upon landing on a particular playing position as described below, the player must take the following actions:

If a playing position Instructs "Move Up 2 Playing positions"; "Move Up 5 Playing positions"; "Go Back 2 Playing positions"; "Go Back 6 Playing positions", a player must take the action indicated.

If a playing position indicates "You Just Confiscated 3 Bags of Crack And 60 Points of Drug Money", a player must add three bags of crack and the indicated number of points of drug money to grids 64C and 64G on his police chart 18.

If a playing position indicates an illustration of contraband items, namely, confiscated items, limousines, the master criminal's drug boat, the master criminal's drug plane, explosives, drug lab, drug money, or bags of crack, a player must refer to his point chart 60 for an identical illustration of the indicated contraband items and must add the confiscated contraband items to grids 64C, 64D and 64E on his police chart 18. A player may later convert the contraband items to a corresponding point value as indicated at grid 64G on the police chart 18.

If a playing position indicates an illustration of five tied-up "Crackheads" a player must add the "Crackheads" to grid 64A in his police chart 18 only after obtaining "guilty" convictions against them using the guilt determination cards 16.

If a playing position indicates "You've Just Made A Bust; You've Got 3 "Crackheads", Confiscated One Boat And Lost One Officer, a player must add the "Crackheads" to grid 64A on his police chart 18 only upon obtaining "guilty" conviction against them using guilt determination cards 16. The player must additionally add the confiscated master criminal's drug boat to grid 64E on his police chart 18 and subtract one police officer in grid 64G from the seven-man task force indicated on his police chart 18. If the dead officer is the last member of the player's task force, the player must move his game piece 20 to first main region 24 to a playing position indicating a task force, to regain a full, seven-man task force.

If a playing position indicates "Lose Your Bulletproof Vest" a player must move his game piece 20 to a playing position in first main region 24 which indicates a bullet proof vest to obtain another bulletproof vest.

If a playing position indicates "You're Being Held Hostage By Mr. Big Cheese" a player must retire to Hostage Holding Cell 54L in fourth main region 30 and remain there until a second player rescues him, or until rolling a double of any number to escape.

If a playing position indicates "You Arrested 1 "Crackhead"" a player must draw a "guilty" guilt determination card 16 to obtain a conviction. If convicted, the player must add the "Crackhead" to grid 64A on his police chart 18.

If a barricade position indicates "Boats Only" a player must own a police boat to penetrate this barricade position. If a player does not have a police boat, he is allowed to reverse the direction of his game piece 20 and upon the next roll of the dice 22, move the game piece 20 away from barricade position.

If a playing position indicates "1000 Points And 10 "Crackheads"" a player must add these bonus points to the point tally at grid 64G on his police chart 18 and also add as many "Crackheads" as possible at grid 64A on his police chart 18, upon obtaining convictions against them using guilt determination cards 16.

If a playing position indicates "You've Just Arrested 2 "Crackheads" And Brainless Brian For Dealing Crack", a player must draw guilt determination cards 16 to obtain convictions against these criminals. The player must add the convicted criminals to grids 64A and 64F on police chart 18.

If a playing position instructs a player to "Roll A Double To Catch A "Crackhead";"Roll A Double To Get 10 "Crackheads"", a player must roll a double of any number to arrest the indicated number of "Crackheads". Upon rolling a double, the player must draw guilt determination cards 16 to obtain convictions, and add any convicted "Crackheads" to grid 64A on his police chart 18.

If a playing position indicates "You've Just Arrested 1 Crackhead And Confiscated 3 Bags Of Crack", a player must draw a guilt determination card 16 and if "guilty", add the "Crackhead" to grid 64A on his police chart 18. The player must additionally add 3 bags of crack to grid 64C on his police chart 18.

If a playing position indicates "You've Just Busted Ignorant Ziggy"; "You've Just Busted Brainless Brian" or "You've Just Busted Jack Crack", a player must draw a guilt determination card 16 against these assassins. The player must add any convicted assassins to grid 64F on his police chart 18. Upon convicting all three assassins and ten "Crackheads", the player may gain entry into the master criminal's lair 62.

If a playing position indicates "If You Land Here, Slide To End" a player is allowed to skip numerous playing positions by sliding his game piece 20 to the playing position marked "End".

If a playing position indicates "You've Just Been Shot, Skip One Turn, Go To Hospital" a player must move his game piece 20 to hospital holding zone 48 and remain on any of the playing positions 54J there for one turn. The player may then roll the dice 22 and leave hospital holding zone 48 after waiting one turn.

If a playing position indicates "You Have Just Lost Your Task Force" a player must move his game piece 20 to a playing position in first main region 24 which indicates a task force. The player must add a full seven-man task force back to grid 64G on his police chart 18

If a playing position indicates "If You Have A Police Dog, You Get 300 Points"; or "If You Have A Crimelab You Get 1000 Points" a player having the indicated police tool, must add the bonus points to grid 64G on his police chart 18. If player does not have the indicated police tool, he does not acquire the indicated bonus points.

If a playing position indicates "Crack Kills"; or "Drugs Kill" or shows an illustration of a cemetery or a prison, the player has landed on a neutral playing position, and the player takes no action except to ponder the consequences of crack cocaine use as indicated by these neutral playing positions.

If a playing position indicates "You've Just Lost All The Drug Money And Drugs Against Mr. Big Cheese" a player must forfeit all drug money and bags of crack acquired up until that point. The player must accordingly subtract all drug money, bags of crack and their corresponding point values from grids 64C, 64D and 64G on his police chart 18.

Additionally, as seen FIG. 2B, FIG. 2C, and FIG. 2D, second 26, third 28 and fourth 30 main regions have a plurality of playing positions 54H indicating a "Crackhouse Crackdown" game logo. These playing positions 54H require that a guidance card 14 be drawn, the guidance cards 14 having an identical logo on one of their faces and instructions, information or neutral anti-drug messages on their opposite faces. Additionally, FIG. 3A and FIG. 3B illustrate the types of information, instructions or anti-drug messages which are typically found on one face of guidance cards 14. In accordance with FIG. 3A and FIG. 3B and additionally, FIG. 5, upon drawing the following typical guidance cards 14, the following steps are required on the player's part:

If the guidance card 14 indicates "Prison Riot—All Players Report To The Prison Area . . . Each Player Can Add 20 Points", each player, on any playing position on playing board 12, must move his game piece 20 to the prison holding zone 46 in second main region 26. Each player must add 20 bonus points to his point tally at grid 64G on police chart 18. Each player may leave the prison holding zone 46 on the next roll.

If the guidance card 14 indicates "If You Have A Task Force And A Search Warrant, Bust The Crack Lab . . . Add 3 "Crackheads"", a player having at least one man in his task force and a search warrant, may confiscate the drug lab, and add it to grid 64E on his police chart 18. The player must draw guilt determination cards 16 to convict the "Crackheads" and add any convicted "Crackheads" to grid 64A on police chart 18.

If the guidance card 14 indicates "Go To The Hospital And Visit Your Doctor . . . You Smoke Too Much . . . Lose 30 Points", a player must move his game piece 20 to the hospital holding zone 48 in second main region 26, but may leave on the next turn. The player must subtract the indicated number of points from his point tally at grid 64G on his police chart 18.

If the guidance card 14 indicates "You Shot 2 "Crackheads" In A Shoot Out—Draw Guilty Or Innocent Cards", a player, upon obtaining guilty determinations, may add the "Crackheads" at grid 64A on his police chart 18.

If the guidance card 14 indicates "You Just Found Explosives, But While An Officer Was Carrying Them, He Tripped and "Boom!", You Lost Your Task Force", a player must move his game piece 20 to a playing position indicating a task force in first main region 24, to obtain a second task force. The player must add a full seven-man task force to grid 64G on his police chart 18, upon obtaining a second task force.

If the guidance card 14 indicates "Anti-Death Card", a player does not need a task force to escape death with this card, because he cannot die. The player must keep this card and can use it later should he lose his task force. This card is good for one turn only.

If the guidance card 14 indicates "Go Directly To The Police Station, The Chief Is Mad, Skip 2 Turns", a player must move his game piece 20 to one of the five playing positions 54B in second subregion 36 in first main region 24 and remain there for 2 turns.

If the guidance card 14 indicates "You Got Shot By A Psycho "Crackhead"", a player must lose his bullet proof vest and move his game piece 20 to a playing position indicating a bulletproof vest in first main region 24 to obtain a second bulletproof vest.

If the guidance card indicates "Your Helicopter Was Shot Out Of The Sky By Jack Crack—Lose 2 Officers", a player owning a helicopter, must remove both the helicopter and two officers from his task force from grids 64F and 64G on his police chart. A player without a helicopter may ignore this card. A player who loses his helicopter must acquire another tally of requisite points to purchase another.

If the guidance card 14 indicates "You Just Lost 3 Officers, Go To The Cemetery, Skip 1 Turn", a player must subtract three men from his task force, as indicated at grid 64G on police chart 18 and move his game piece 20 to cemetery holding zone 42 in the second main region 26 for one turn.

If the guidance card 14 indicates "Your Aunt Agness's Younger Sister's Husband's Friend's Younger Brother's Baby Sitter Died, Go To The Cemetery And Skip 1 Turn", a player must move his game piece 20 to cemetery holding zone 42 in second main region 26 for one turn.

If the guidance card 14 indicates "You've Been In A Shootout With Crackheads! You Got Shot In The Arm, Go To The Hospital And Skip 1 Turn", a player must move his game piece 20 to hospital holding zone 48 in second main region 26 for one turn.

If the guidance card 14 indicates "You've Lost Your Search Warrant, Go To The Police Station And Get Another", a player must move his game piece 20 to any one of playing positions 54B in second subregion 36 in first main region 24 to obtain a second search warrant.

If the guidance card 14 indicates "The Chief Wants To Give You Your Paycheck, Go To The Police Station, Skip A Turn And Add 50 Points", a player must move his game piece 20 to playing positions 54B in second subregion 36 in first main region 24 for one turn and must add the indicated number of points at grid 64G on police chart 18.

If the guidance card 14 indicates "You've Just Confiscated 20 Bags Of Crack", a player must add the indicated number of crack bags to grid 64C on his police chart 18.

If the guidance card 14 indicates "Operation Target Crack—Go Bust Any "Crackhead" You Want On Any Square", a player must choose a playing position having at least one "Crackhead" indicated. If a contraband item is also indicated on the playing position, the player also acquires the contraband item. The player must draw guilt determination cards 16 to convict any "Crackheads". The player must add any convicted "Crackheads" and any contraband items to the appropriate grids 64A, 64C, 64D or 64E on his police chart 18.

If the guidance card 14 indicates "You Caught 1 Crackhead Smoking Crack, Bust Him And Confiscate 1 bag Of Crack", a player must draw a guilt determination card 16 to convict the "Crackhead". The player must add the convicted "Crackhead" and one bag of crack to grids 64A and 64C on his police chart 18.

If the guidance card 14 indicates "Go Directly To Mr. Big Cheese's Hostage Holding Cell", a player must move his game piece 20 to Hostage Holding Cell 54L in fourth main region 30. The player must remain there until rescued by a second player or until the first player rolls a double of any number.

If the guidance card 14 indicates "Anti-Hostage Card", a player may keep this card and may avoid having to move his game piece 20 to Hostage Holding Cell 54L in fourth main region 30, if he ever has to face this situation. The player may use this card for one turn only.

If the guidance card 14 indicates "You've Walked Down A Dark Alley And Got Beat Up . . . Go To The Hospital And Skip 1 Turn!", a player must move his game piece 20 to hospital holding zone 48 in second main region 26 and remain there for one turn.

If the guidance card 14 indicates "Go To Any Square You Want, Then Skip 2 Turns", a player must move his game piece 20 to any playing position on pathway 52, including into the portion of pathway 52 leading into the master criminal's lair 62. A player may not move to the end 58 or start 56 positions. A player need not have acquired the requisite ten "Crackheads" and three assassins to advance into the master criminal's lair 62 with this card. The player must remain at the chosen playing position for 2 turns.

If the guidance card 14 indicates "Late Night Stakeout, Go To Shipping Yard, Skip 1 Turn, Then Bust 5 "Crackheads"", a player must move his game piece 20 to shipping yard holding zone 44 in second main region 26 for one turn. The player must draw guilt determination cards 16 to obtain convictions against the indicated number of "Crackheads". The player must add any convicted "Crackheads" to grid 64A on his police chart 18.

If the guidance card 14 indicates "Your Police Dog Has Been Shot Dead, Lose Your Police Dog", a player loses his police dog, if he has one. To get another, a player must acquire the requisite amount of points to purchase another police dog. A player having a police dog must subtract the police dog from grid 64F on his police chart 18. If a player does not have a police dog, he must ignore this card.

If the guidance card 14 indicates "Your Police Boat Was Blown Sky High, Killed 2 Officers", a player loses his police boat, if he has one. To get another, the player must acquire the requisite amount of points for a new police boat. The player, upon losing his police boat, likewise loses his ability to penetrate barricade positions marked "Boats Only". The player must subtract the police boat from grid 64F on his police chart 18. If the player does not have a police boat, he must ignore this card. The player must also subtract two police officers from grid 64G on his police chart 18. If these are the last two officers in his task force, the player must move his game piece 20, to a playing position in first main region 24 which indicates a task force.

If the guidance card 14 indicates "It's Your Lucky Day! You've Found A Pound Of Crack In Mr. Big Cheese's Car. Pick A Guilty Card And You Win Or Innocent And Back On The Streets", a player may win the entire game by drawing a "guilty" guilt determination card 16. If the player draws an "innocent" card, the player must endure the frustration of seeing the master criminal set free. The player is not allowed to add the pound of crack to his police chart 18.

If the guidance card 14 indicates "You Just Confiscated 60 Points of Drug Money", a player must add the indicated number of points to grid 64G on his police chart 18.

If the guidance card 14 indicates "Drug Kill"; "Crack Kills", or another anti-drug message, a player takes no action except to ponder the anti-drug message indicated.

If the guidance card 14 indicates "Your Tank Blew Up With You And Your Task Force In It, You're Dead (And Out Of The Game)", a player must retire his game piece 20 to cemetery holding zone 42 in second main region 26 and destroy his police chart 18. The player has the option to re-start the game at start position 56 with a new game piece 20 and a new police chart 18.

If the guidance card 14 indicates "There Is A "Crackhead" in the Parking Lot Stealing Stereos, Add 1 "Crackhead" And Stolen Items", a player must draw a guilt determination card 16 to convict the "Crackhead". The player must add the convicted "Crackhead" and stolen items to grids 64A and 64E on his police chart.

If the guidance card 14 indicates "Jailbreak—All Players Report To The Prison Area, Each Player Loses 2 Crackheads", each player must move his game piece 20 to prison holding zone 46 in second main region 26. Each player may leave on the next roll. Each player must subtract the indicated number of "Crackheads" from grid 64A on his police chart 18.

If the guidance card 14 indicates "You've Caught Two "Crackheads" In The School Trying To Sell Crack To A Couple Of Kids, There's No Need To Draw A Guilty Or Innocent Card . . . These Suspects Are Already Guilty!", a player may add the indicated number of "Crackheads" to grid 64A on his police chart 18 without having to draw any guilt determination cards 16.

If the guidance card 14 indicates "You're Cruisin' Up 13th Street And You See 2 "Crackheads" Chasing An Old Lady, Bust 2 "Crackheads" And Add 10 Points", a player must draw guilt determination cards 16 to convict the indicated number of "Crackheads". The player must add any convicted "Crackheads" to grid 64A on his police chart 18. The player must also add the indicated number of points to grid 64G on his police chart 18.

If the guidance card 14 indicates "You've Lost Your Gun, 2 Officers Were Shot Dead!", a player must subtract his gun and the indicated number of officers from his seven-man task force at grids 64G on his police chart 18. If the player has lost his entire task force, he must move his game piece 20 to a playing position indicating a task force in first main region 24, to acquire a second task force. The player must have a gun to advance into the master criminal's lair 62. A Player is entitled to have two guns. If the player has lost both guns, he must move his game piece 20 to a playing position in first main region 24 which indicates armaments to obtain another gun.

The guidance cards 14 add an element of surprise to the method of playing the board game apparatus 10 of the present invention, by requiring the player to draw a guidance card 14 which can affect the player in unknown and surprising ways. This element of surprise is intended to model the same element of surprise which every police officer must encounter in daily life on the streets.

Referring still to FIG. 1, FIG. 2C and FIG. 5, third main region 28 has a plurality of playing positions which are substantially similar to the playing positions present in first 24 and second 26 main regions, previously discussed. The substantial similarities between the playing positions of the third main region 28 and second main region 26, require similar actions and effects on the player's part. Therefore, to avoid unnecessary duplicity, only the following playing positions present in third main region 28 are worthy of additional mention:

If a playing position indicates "Switch Places With Any Player", a player must exchange his game piece 20 with the game piece 20 of a second player. A player may exchange with any player on any playing position, including the start 56 or end 58 positions. If a player is playing as a single player, he must ignore these instructions and roll again.

If a playing position indicates "You Got Shot By A "Crackhead", He Killed One Cop" a player loses his bulletproof vest and must subtract his bulletproof vest and one police officer from his seven-man task force on grid 64G on his police chart. A player must move his game piece 20 to a playing position in first main region 24, indicating a bulletproof vest, to obtain a second bulletproof vest. If the deceased police officer was the last member of the seven-man task force, a player must move his game piece 20 to a playing position indicating a task force in first main region 24.

If a playing position indicates an illustration of an island, a player takes no action upon landing on this neutral playing position.

If a playing position indicates an illustration of a "Jack Crack" surrendering and holding his hands up, a player must draw a guilt determination card 16 to obtain a conviction against "Jack Crack". If a conviction is obtained, the player adds "Jack Crack" to grid 64F on his police chart 18.

If a playing position indicates "Say "Crack Kills" and add 1000 Points", a player must utter the indicated words and, upon doing so, must add the indicated amount of points to grid 64G on his police chart 18.

If a playing position indicates "You Confiscated 2 Million Dollars Of Drug Money, Add 1000 Points", a player must add the indicated amount of points to grid 64G on his police chart 18, for confiscating the indicated amount of drug money.

If a playing position indicates an illustration of Mr. Big Cheese, a player must draw a guilt determination card 16. Upon obtaining a conviction against Mr. Big Cheese, the player wins the entire game. If Mr. Big Cheese is deemed innocent, the player takes no action except to watch in frustration as the master criminal is set free.

If a playing position indicates "You've Just Arrested 6 "Crackheads" For Cooking Crack", a player must draw guilt determination cards 16 to obtain convictions against the indicated number of "Crackheads". The player must add any convicted "Crackheads" to grid 64A on his police chart 18. The player does not add additional points for confiscated crack or the crack lab used to cook the crack.

Referring still to FIG. 1, FIG. 2D and FIG. 5, fourth main region 30 has a plurality of playing positions which are substantially similar to the playing positions present in the second 26 and third 28 main regions, previously discussed. The substantial similarities between the playing positions of the fourth main region 30 and the second 26 and third 28 main regions require similar actions and effects on the player's part as described previously. Therefore, to avoid unnecessary duplicity, only the following playing positions present in the fourth main region 30 are worthy of additional mention:

If a playing position indicates "Go Undercover For Three Turns", a player must go undercover for three consecutive turns. Once undercover, a player may obtain automatic convictions against any criminal on the playing board, which a player arrests while undercover, without having to draw guilt determination cards 16. The player must then add these convicted criminals to grids 64A or 64F on police chart 18.

If a playing position indicates "You've Lost Your Undercover, Go Back Five Playing positions", a player must forfeit his undercover status upon landing on this playing position. A player does not have to forfeit any convictions he obtained against criminals while he was undercover. The player must move his game piece 20 back, the indicated number of playing positions.

If a playing position indicates "Your Cover Has Been Blown, You Are Being Held Hostage By Mr. Big Cheese. Go To The Hostage Cell", a player must forfeit his undercover status. A player does not have to forfeit any convictions he obtained against criminals while he was undercover. The player must move his game piece 20 to Hostage Holding Cell 54L and remain there until freed by a second player or until the player rolls a double of any number.

If a playing position indicates "The Chief Says You Work Too Hard, Take A Day Off . . . Go To The Police Station, Skip A Turn", a player must return to any of the five playing positions 54B in second subregion of first main region 24 for one turn.

If a playing position indicates "You And Your Whole Task Force Are Now Hostages Of Mr. Big Cheese", a player and his task force must move to Hostage Holding Cell 54L in fourth main region 30. A second player landing on Hostage Holding Cell 54L or else the first player rolling a double of any number will free both the player and his task force.

If a playing position indicates "You And 6 Police Officers Were Shot Dead", a player is out of the game and must retire his game piece 20 to cemetery holding zone 42 in second main region 26 and must destroy his police chart 18. The player has the option of beginning the game again at start position 56 with a new game piece 20 and police chart 18.

If a playing position indicates "Go Back To Start", a player must move his game piece 20 back to start position 56. The player need not forfeit his police chart 18.

If a playing position indicates "You Lost Your Search Warrant", a player must move his game piece 20 back to a playing position 54B in second subregion 36 of first main region 24 to obtain a second search warrant.

If a playing position indicates "If You Have Any Of Mr. Big Cheese's Men, Let Them Go, They Made Bail" a player must free all three of the master criminal's assassins, "Jack Crack", "Brainless Brian", and "Ignorant Ziggy" and likewise the player must eliminate all three assassins from grid 64F on his police chart 18. The player must once again set out to convict all three assassins before being able to enter the master criminal's lair 62.

If a playing position indicates an illustration of three tied-up police officers, a player, upon landing on this position frees the tied-up police officers and must add all three to his task force at grid 64G on police chart 18. If the player has a full seven-man task force, he may add the three additional police officers for a maximum of ten men in his task force.

If a playing position Indicates "Boom You're Dead" a player must retire his game piece 20 to cemetery holding zone 42 in second main region 26 and destroy his police chart 18. The player has the option of beginning the game again with a new game piece 20 and police chart 18.

Upon advancing through the fourth main region 30, and into the master criminal's lair 62, a player will eventually near end position 58 where the master criminal, Mr. Big Cheese, resides. To reach end position 58 a player must roll a number equivalent to, or greater than, the number of playing positions necessary to make it to end position 58. Upon reaching end position 58, a player must perform the final task of convicting Mr. Big Cheese, to win the game. The player must draw a guilt determination card 16 wherein a "guilty" card convicts Mr. Big Cheese and an "innocent" card requires the hapless player to move his game piece 20 back to start position 56 in first main region 24 to try again. If the player must move back to start position 56 he may keep his police chart to use in once again attaining end position 58.

Once one player has succeeded in convicting Mr. Big Cheese, the game ends for all players at that point. If the players wish to establish criteria among themselves to determine second place or third place finishers, etc. they may do so.

Accordingly, it will be seen that this invention provides a board game apparatus 10 for educating its players against the perils of involvement with crack cocaine. The invention further provides a method for playing the board game apparatus 10.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A board game apparatus, comprising:

(a) a playing board including:

(i) a start position and an end position, (ii) a pathway extending about the surface of said playing board between said start position and said end position, said pathway divided into a plurality of side by side shapes defining playing positions, each playing position representing point values or giving information or giving instructions or requiring the taking of a card or designating a neutral position or designating a barricade position, (iii) a plurality of said playing positions adjacent to said start position identifying a plurality of prerequisite items;

b) a police chart, said police chart having means for monitoring a tally of points;

(c) a game piece corresponding to a player, said game piece movable in a player's turn a selected number of playing positions upon said pathway;

(d) a random number generator for selecting the number of playing positions said game piece must move.

2. The board game apparatus of claim 1, wherein said playing board has a dividing means for dividing said playing board into a plurality of main regions, said pathway extending through said main regions.

3. The board game apparatus of claim 2, wherein a first of said main regions includes said start position, said first main region further including said plurality of playing position identifying said plurality of prerequisite items.

4. The board game apparatus of claim 3, wherein a plurality of subregions are disposed upon said playing board, said subregions representing player holding zones or identifying prerequisite items or representing drug prevention indicia, or representing spaces for the placement of cards.

5. The board game apparatus of claim 4, wherein said police chart has means for identifying point values awarded for confiscating a plurality of contraband items, point values awarded for convicting a plurality of criminals, point values awarded for taking a plurality of hostages and point totals required to obtain a plurality of police tools, said police chart further having means for monitoring the amount of contraband items confiscated, amount of criminals convicted, amount of total points obtained, amount of prerequisite items obtained, amount of hostages taken, and amount of police tools obtained, said police chart further having means for identifying the player as a police officer.

6. The board game apparatus of claim 5, wherein a one of said main regions contains said end position, said end position having a master criminal residing thereon, said pathway adjacent to said end position representing a high risk zone.

7. The board game apparatus of claim 6, further including a plurality of guidance cards, said guidance cards corresponding with a plurality of said playing positions on said playing board.

8. The board game apparatus of claim 7, further including a plurality of guilt determination cards, said guilt determination cards corresponding with a plurality of said playing positions on said playing board, said guilt determination cards further corresponding with said guidance cards.

9. A drug education game, comprising:

(a) a playing board, including:

(i) a start position and an end position, (ii) a pathway extending about the surface of said playing board between said start position and said end position, said pathway divided into a plurality of side by side shapes defining playing positions, each playing position representing point values or giving information or giving instructions or requiring the taking of a card or designating a neutral position or designating a barricade position, (iii) dividing means for dividing said playing board into a plurality of main regions, said pathway extending through said main regions, said pathway in a one of said main regions including playing positions representing a plurality of prerequisite items, (iv) a plurality of subregions disposed throughout said main regions, said subregions representing player holding zones or identifying prerequisite items or representing drug prevention indicia, or representing spaces for the placement of cards;

b) a police chart, said police chart having means for monitoring a tally of points obtained by a player;

(c) a game piece corresponding to a player, said game piece movable in a player's turn a selected number of playing positions upon said pathway;

(d) a plurality of guidance cards, said guidance cards giving information on a first face and having identifying indicia on a second face corresponding with identical identifying indicia placed upon a plurality of said playing positions, said indicia indicating for a player to choose a one of said guidance cards;

(e) a plurality of guilt determination cards, said guilt determination cards corresponding with a plurality of said playing positions on said playing board, said guilt determination cards further corresponding with said plurality of guidance cards;

(f) a random number generator for selecting the numbers of playing positions said game piece must move.

10. The drug education game of claim 9, wherein said police chart includes means for identifying point values awarded for confiscating a plurality of contraband items, point values awarded for convicting a plurality of criminals, point values awarded for taking a plurality of hostages and point totals required to obtain a plurality of police tools, said police chart further having means for monitoring the amount of contraband items confiscated, amount of criminals convicted, amount of total points obtained, amount of prerequisite items obtained, amount of hostages taken, and amount of police tools obtained, said police chart further having means for identifying the player as a police officer.

11. The drug education game of claim 10, wherein a master criminal resides on said end position, said pathway adjacent to said end position representing a high risk zone.

12. A board game for educating players about the consequences of drug trafficking, comprising (a) a playing board including:

(i) a start position and an end position, (ii) a pathway extending about the surface of said playing board between said start position and said end position, said pathway divided into a plurality of side by side shapes defining playing positions, each playing position representing point values or giving instructions or giving information or requiring the taking of a card or designating a neutral position or designating a barricade position, (iii) dividing means for dividing said playing board into four main regions, said pathway extending through said main regions, (iv) a first of said main regions including said start position, said pathway adjacent to said start position in said first of said main regions including a plurality of playing positions identifying a plurality of prerequisite items, (v) a one of said main regions including said end position, said end position having a master criminal residing thereon, said pathway adjacent to said end position representing a high risk zone, (vi) a plurality of subregions disposed within said main regions, said subregions representing player holding zones or identifying prerequisite items or representing drug prevention indicia, or representing spaces for the placement of cards;

b) a police chart, said police chart including means for identifying point values awarded for confiscating a plurality of contraband items, point values awarded for convicting a plurality of criminals, point values awarded for taking a plurality of hostages and point totals required to obtain a plurality of police tools, said police chart further having means for monitoring an amount of contraband items confiscated, amount of criminals convicted, amount of total points obtained, amount of prerequisite items obtained, amount of hostages taken, and amount of police tools obtained, said police chart further having means for identifying the player as a police officer;

(c) a game piece corresponding to a player, said game piece movable in a player's turn a selected number of playing positions upon said pathway;

(d) a plurality of guidance cards, said guidance cards giving information on a first face and having identifying indicia on a second face corresponding with identical identifying indicia placed upon a plurality of said playing positions, said indicia indicating for a player to choose one of said guidance cards;

(e) a plurality of guilt determination cards, said guilt determination cards corresponding with a plurality of said playing positions on said playing board, said guilt determination cards further corresponding with said plurality of guidance cards;

(f) a random number generator for selecting the numbers of playing positions said game pieces must move.

13. A method for playing a board game apparatus, said board game apparatus comprising a playing board divided into a plurality of main regions having a start position and an end position, a pathway comprised of a plurality of playing positions disposed between said start and end positions, a plurality of subregions disposed upon said playing board, a police chart, one or more game pieces, a plurality of guidance cards, a plurality of guilt determination cards and a random number generator, the method comprising:

(a) each player assuming the role of a law enforcement figure;

(b) each player positioning a corresponding game piece on said start position at the commencement of a game;

(c) obtaining a number from said random number generator;

(d) each player moving said corresponding game piece, in a player's turn, a selected number of said playing positions along said pathway into a first of said main regions as indicated by said random number generator;

(e) acquiring a plurality of prerequisite items from said first of said main regions;

(f) advancing said game piece into said additional main regions upon acquiring said prerequisite items;

(g) acting on information indicated on said playing positions when said game piece is moved to a playing position having information indicated thereon;

(h) drawing a guidance card upon moving said game piece to a playing position which indicates that a guidance card must be drawn;

(i) acting on the information indicated by said guidance card;

(j) drawing a guilt determination card which determines whether a criminal is to be convicted, or set free, upon moving said game piece to a playing position which indicates that a guilt determination card must be drawn;

(k) acquiring an amount of points by obtaining convictions against a plurality of criminals and by confiscating a plurality of contraband items;

(l) monitoring said amount of points acquired by tallying all contraband items confiscated and criminals convicted and assigning point values from said police chart to said contraband items and convicted criminals;

(m) gaining entry into said end position by convicting a requisite number of criminals, a master criminal residing at said end position;

(n) winning said game by moving said game piece to said end position and selecting a final guilt determination card to obtain a conviction against said master criminal.

14. The method as recited in claim 13, wherein said player applies said amount of points toward the acquisition of one or more police tools.

15. The method as recited in claim 14, wherein the acquisition of said police tools enables said player to obtain an increased amount of arrested criminals and confiscated evidence items, said police tools allowing a player to gain entrance to said end position in a shorter period of time, said police tools also allowing a player to penetrate a plurality of barricade positions indicating bonus point amounts.

16. The method as recited in claim 15, wherein upon said player reaching said end position and choosing a guilt determination card which sets said master criminal free, said player must move said game piece back to said start position and begin the game again.

17. The method as recited in claim 16, wherein a player subtracts points from said tally of points upon being taken hostage by said master criminal or if said information on said playing positions or said guidance cards indicate for said player to subtract points from his point tally.

18. A method of playing a game as recited in claim 17, wherein said random number generator is a pair of dice, said player obtaining an additional turn upon rolling a double of any number on the face of said dice.

19. A method of playing a game as recited in claim 18, wherein said prerequisite items include a seven-man task force, a bulletproof vest, armaments, police badge and a search warrant, the loss of any of these prerequisite items having the following consequences and requiring the following actions:

(a) the loss of a task force reduces a players chances of successfully engaging criminals and arresting them and upon losing said task force, said player must return to said first main region to obtain an additional task force;

(b) the loss of a bulletproof vest leaves a player vulnerable to a criminal's bullets and upon being shot, said player has two possible fates:

(i) said player may be wounded and must spend a portion of the game in a hospital holding zone, wherein upon leaving said hospital holding zone, said player must return to said first main region to obtain an additional bulletproof vest, (ii) said player may also be killed, and then must retire his game piece to a cemetery holding zone for the remainder of said game, said player may then acquire an additional game piece and a new police chart and begin said game at said start position;

(c) the loss of armaments eliminates a player's ability to gain access to said end position to arrest said master criminal, said player must return to said first main region to obtain additional armaments;

(d) the loss of a badge eliminates a player's authority as a law enforcement figure, thus preventing said player from being able to arrest criminals or contraband items, said player must return to said first main region to obtain another badge;

(e) the loss of a search warrant eliminates a player's ability to gain access to said end position to arrest said master criminal, said player must return to said first main region to obtain another search warrant.

20. The method as recited in claim 19, wherein a barricade position affects the movement of said game piece in the following manner:

(a) said game piece must move in a single direction throughout the progress of a game, said game piece being allowed to change directions only upon encountering and being unable to cross a barricade position;

(b) said game piece being allowed to move in a single direction through said barricade position only upon acquiring a police tool, said police tool enabling said player to penetrate said barricade position, 21. The method as recited in claim 20, wherein if a first player moves said game piece to a playing position indicating a hostage holding cell, said first player remaining upon said hostage holding cell until rolling a double number with said chance means, or until a second player reaches said hostage holding cell to free said first player.

22. A method of playing a board game wherein a player assumes the role of a police officer engaging in a street narcotics operation wherein the primary goal is to convict a master criminal, said board game comprising a playing board divided into a plurality of main regions having a start position and an end position, a pathway comprised of a plurality of playing positions disposed between said start and end positions, a plurality of subregions disposed upon said playing board, a police chart, one or more game pieces, a plurality of guidance cards, a plurality of guilt determination cards and a random number generator, the method comprising:

(a) each player positioning a corresponding game piece on said start position at the commencement of a game;

(b) obtaining a number from said random number generator;

(c) each player moving said corresponding game piece, in a player's turn, a selected number of said playing positions along said pathway into a first of said main regions as indicated by said random number generator:

(d) acquiring a plurality of prerequisite items from said first of said main regions;

(f) advancing said game piece into said additional main regions upon acquiring said prerequisite items;

(g) acting on information indicated on said playing positions when said game piece is moved to a playing position having information indicated thereon;

(h) drawing a guidance card upon moving said game piece to a playing position which indicates that a guidance card must be drawn;

(i) acting on the information indicated by said guidance card;

(j) drawing a guilt determination card which determines whether a criminal is to be convicted, or set free, upon moving said game piece to a playing position which indicates that a guilt determination card must be drawn;

(k) acquiring points by obtaining convictions against a plurality of criminals and by confiscating a plurality of contraband items;

(l) monitoring the amount of points acquired by tallying all contraband items confiscated and criminals convicted and assigning point values from said police chart to said contraband items and convicted criminals:

(m) applying said amount of points toward the acquisition of one or more police tools;

(n) said police tools allowing a player to obtain an increased amount of arrested criminals and confiscated evidence items, said police tools allowing a player to gain entrance to said end position in a shorter period of time, said police tools also allowing a player to penetrate a plurality of barricade positions indicating bonus point amounts;

(o) gaining entry into said end position by convicting a requisite number of criminals, a master criminal residing at said end position;

(p) winning the game by moving said game piece to said end position and selecting a final guilt determination card to obtain a conviction against said master criminal.

23. The method as recited in claim 22, wherein upon said player reaching said end position and choosing a guilt determination card which sets said master criminal free, said player must move said game piece back to said start position and begin the game again.

24. The method as recited in claim 23, wherein a player subtracts points from said tally of points upon being taken hostage by said master criminal or if said information on said playing positions or said guidance cards indicate for said player to subtract points from his point tally.

25. A method of playing a game as recited in claim 24, wherein said random number generator is a pair of dice, said player obtaining an additional turn upon rolling a double of any number on the face of said dice.

26. A method of playing a game as recited in claim 25, wherein said prerequisite items include a seven-man task force, a bulletproof vest, armaments, police badge and a search warrant, the loss of any of these prerequisite items having the following consequences and requiring the following actions:

(a) the loss of a task force reduces a players chances of successfully engaging criminals and arresting them and upon losing said task force, said player must return to said first main region to obtain an additional task force;

(b) the loss of a bulletproof vest leaves a player vulnerable to a criminal's bullets and upon being shot, said player has two possible fates:

(i) said player may be wounded and must spend a portion of the game in a hospital holding zone, wherein upon leaving said hospital holding zone, said player must return to said first main region to obtain an additional bulletproof vest, (ii) said player may also be killed, and then must retire his game piece to a cemetery holding zone for the remainder of said game, said player may then acquire an additional game piece and a new police chart and begin said game at said start position;

(c) the loss of armaments eliminates a player's ability to gain access to said end position to arrest said master criminal, said player must return to said first main region to obtain additional armaments;

(d) the loss of a badge eliminates a player's authority as a law enforcement figure, thus preventing said player from being able to arrest criminals or contraband items, said player must return to said first main region to obtain another badge;

(e) the loss of a search warrant eliminates a player's ability to gain access to said end position to arrest said master criminal, said player must return to said first main region to obtain another search warrant.

27. The method as recited in claim 26, wherein a barricade position affects the movement of said game piece in the following manner:

(a) said game piece must move in a single direction throughout the progress of a game, said game piece being allowed to change directions only upon encountering and being unable to cross a barricade position;

(b) said game piece being allowed to move in a single direction through said barricade position only upon acquiring a police tool, said police tool enabling said player to penetrate said barricade position.

28. The method as recited in claim 27, wherein if a first player moves said game piece to a playing position indicating a hostage holding cell, said first player remaining upon said hostage holding cell until rolling a double number with said chance means, or until a second player reaches said hostage holding cell to free said first player.

29. A method of playing a board game wherein a player assumes the role of a police officer engaging in a street narcotics operation wherein the primary goal is to convict a master criminal, said board game comprising a playing board divided into a plurality of main regions having a start position and an end position, a pathway comprised of a plurality of playing positions disposed between said start and end positions, a plurality of subregions disposed upon said playing board, a police chart, one or more game pieces, a plurality of guidance cards, a plurality of guilt determination cards and a random number generator, the method comprising:

(a) each player positioning a corresponding game piece on said start position at the commencement of a game;

(b) obtaining a number from said random number generator;

(c) each player moving said corresponding game piece, in a player's turn, a selected number of said playing positions along said pathway into a first of said main regions as indicated by said random number generator;

(d) acquiring a plurality of prerequisite items from said first of said main regions;

(f) advancing said game piece into said additional main regions upon acquiring said prerequisite items;

(g) acting on information indicated on said playing positions when said game piece is moved to a playing position having information indicated thereon;

(h) drawing a guidance card upon moving said game piece to a playing position which indicates that a guidance card must be drawn;

(i) acting on the information indicated by said guidance card;

(j) drawing a guilt determination card which determines whether a criminal is to be convicted, or set free, upon moving said game piece to a playing position which indicates that a guilt determination card must be drawn;

(k) acquiring points by obtaining convictions against a plurality of criminals and by confiscating a plurality of contraband items;

(l) subtracting points upon being taken hostage by said master criminal or if said information on said playing positions or said guidance cards indicate for said player to subtract points;

(m) monitoring the amount of points acquired by tallying all contraband items confiscated and criminals convicted and assigning point values from said police chart to said contraband items and convicted criminals;

(n) applying said amount of points toward the acquisition of one or more police tools;

(o) said police tools allowing a player to obtain an increased amount of arrested criminals and confiscated evidence items, said police tools allowing a player to gain entrance to said end position in a shorter period of time, said police tools also allowing a player to penetrate a plurality of barricade positions indicating bonus point amounts;

(p) gaining entry into said end position convicting a requisite number of criminals, a master criminal residing at said end position;

(q) winning the game by moving said game piece to said end position and selecting a final guilt determination card to obtain a conviction against said master criminal.

* * * * *